US006914558B1

(12) United States Patent
Shirosaka et al.

(10) Patent No.: US 6,914,558 B1
(45) Date of Patent: Jul. 5, 2005

(54) VARIABLE DIRECTIVITY ANTENNA APPARATUS AND RECEIVER SYSTEM USING SUCH ANTENNA APPARATUS

(75) Inventors: Toshiaki Shirosaka, Kobe (JP); Toshio Fujita, Kobe (JP); Kiyotaka Tatekawa, Kobe (JP); Eiji Shibuya, Kobe (JP)

(73) Assignee: DX Antenna Company, Limited, Kobe (JP)

( * ) Notice: Subject to any disclaimer, the term of this patent is extended or adjusted under 35 U.S.C. 154(b) by 0 days.

(21) Appl. No.: 10/977,441

(22) Filed: Oct. 29, 2004

(30) Foreign Application Priority Data

Mar. 16, 2004 (JP) ..... 2004-074448

(51) Int. Cl.[7] ..... H01Q 3/22

(52) U.S. Cl. ..... 342/371

(58) Field of Search ..... 342/370, 371, 342/369; 343/789, 816, 820

(56) References Cited

U.S. PATENT DOCUMENTS

| | | | | |
|---|---|---|---|---|
| 3,806,930 A | * | 4/1974 | Gobert | 342/368 |
| 5,585,803 A | * | 12/1996 | Miura et al. | 342/372 |
| 6,809,691 B2 | * | 10/2004 | Yamamoto et al. | 343/702 |
| 2004/0196202 A1 | * | 10/2004 | Shirosaka et al. | 343/795 |

FOREIGN PATENT DOCUMENTS

JP SHO63-38574 Y2 10/1988

* cited by examiner

*Primary Examiner*—Dao Phan
(74) *Attorney, Agent, or Firm*—Duane Morris LLP

(57) ABSTRACT

An antenna device (2*a*) includes first and second dipole antennas (4*a*, 6*a*) spaced from each other by a distance smaller than a quarter of a received wavelength. An antenna device (2*b*) includes third and fourth dipole antennas (4*a*, 6*a*) spaced from each other by the distance and is disposed orthogonal to the antenna device (2*a*). A first phase adjusting circuit (104*a*) combines signals from the first and second antennas (4*a*, 6*a*) after adjusting their phases, in such a manner that the resultant combined signal selectively assumes a forward directivity state exhibiting a forward directivity and a backward directivity state exhibiting a backward directivity. Similarly, a second phase adjusting circuit (104*b*) combines signals from the third and fourth antennas (4*b*, 6*b*) after adjusting their phases, in such a manner that the resultant combined signal selectively assumes a rightward directivity state exhibiting a rightward directivity and a leftward directivity state exhibiting a leftward directivity. Signal combining circuits (1136*a*, 1136*b*, 1138) combines signals from the first and second phase adjusting circuits (104*a*, 104*b*) after adjusting their signal levels to thereby provide an output signal exhibiting directivity oriented in a predetermined direction. The first phase adjusting circuit (104*a*) phase shifts the signal from one of the first and second antennas (4*a*, 6*a*) by a predetermined amount to provide the forward directivity state, or phase shifts the signal from the other of the first and second antennas by the predetermined amount to provide the backward directivity state. The second phase adjusting circuit (104*b*) phase shifts the signal from one of the third and fourth antennas (4*b*, 6*b*) by a predetermined amount to provide the leftward directivity state, or phase shifts the signal from the other of the third and fourth antennas by the predetermined amount to provide the rightward directivity state.

13 Claims, 11 Drawing Sheets

| Azimuth Angle | Forward/Backward Switching | | | | Variable Attenuators | | | | | | Antenna 2a | | Antenna 2b | | Polarity Switching | | Band Switching | |
|---|---|---|---|---|---|---|---|---|---|---|---|---|---|---|---|---|---|---|
| | | | | | 0dB | 7dB | ∞dB | 0dB | 7dB | ∞dB | | | | | | | | |
| | A | a | B | b | C | D | E | F | G | H | I | J | K | L | M | N | P | Q |
| 0 | 0 | 1 | 1 | 0 | 1 | 0 | 0 | 0 | 0 | 1 | 0 | 0 | 0 | 0 | 0 | 0 | 1 | 0 |
| 22.5 | 0 | 1 | 1 | 0 | 1 | 0 | 0 | 0 | 1 | 0 | 0 | 1 | 1 | 0 | 0 | 0 | 1 | 0 |
| 45 | 0 | 1 | 1 | 0 | 1 | 0 | 0 | 1 | 0 | 0 | 0 | 1 | 1 | 0 | 0 | 0 | 1 | 0 |
| 67.5 | 0 | 1 | 1 | 0 | 0 | 1 | 0 | 1 | 0 | 0 | 0 | 1 | 1 | 0 | 0 | 0 | 1 | 0 |
| 90 | 1 | 0 | 1 | 0 | 0 | 0 | 1 | 1 | 0 | 0 | 0 | 0 | 0 | 0 | 0 | 0 | 1 | 0 |
| 112.5 | 1 | 0 | 1 | 0 | 0 | 1 | 0 | 1 | 0 | 0 | 0 | 1 | 0 | 1 | 0 | 0 | 1 | 0 |
| 135 | 1 | 0 | 1 | 0 | 1 | 0 | 0 | 1 | 0 | 0 | 0 | 1 | 0 | 1 | 0 | 0 | 1 | 0 |
| 157.5 | 1 | 0 | 1 | 0 | 1 | 0 | 0 | 0 | 1 | 0 | 0 | 1 | 0 | 1 | 0 | 0 | 1 | 0 |
| 180 | 1 | 0 | 0 | 1 | 1 | 0 | 0 | 0 | 0 | 1 | 0 | 0 | 0 | 0 | 0 | 0 | 1 | 0 |
| 202.5 | 1 | 0 | 0 | 1 | 1 | 0 | 0 | 0 | 1 | 0 | 1 | 0 | 0 | 1 | 0 | 0 | 1 | 0 |
| 225 | 1 | 0 | 0 | 1 | 1 | 0 | 0 | 1 | 0 | 0 | 1 | 0 | 0 | 1 | 0 | 0 | 1 | 0 |
| 247.5 | 1 | 0 | 0 | 1 | 0 | 1 | 0 | 1 | 0 | 0 | 1 | 0 | 0 | 1 | 0 | 0 | 1 | 0 |
| 270 | 0 | 1 | 0 | 1 | 0 | 0 | 1 | 1 | 0 | 0 | 0 | 0 | 0 | 0 | 0 | 0 | 1 | 0 |
| 292.5 | 0 | 1 | 0 | 1 | 0 | 1 | 0 | 1 | 0 | 0 | 1 | 0 | 1 | 0 | 0 | 0 | 1 | 0 |
| 315 | 0 | 1 | 0 | 1 | 1 | 0 | 0 | 1 | 0 | 0 | 1 | 0 | 1 | 0 | 0 | 0 | 1 | 0 |
| 337.5 | 0 | 1 | 0 | 1 | 1 | 0 | 0 | 0 | 1 | 0 | 1 | 0 | 1 | 0 | 0 | 0 | 1 | 0 |

FIG. 8

| Azimuth Angle | Forward/Backward Switching | | | | Variable Attenuators | | | | | | Antenna 2a | | Antenna 2b | | Polarity Switching | | Band Switching | |
|---|---|---|---|---|---|---|---|---|---|---|---|---|---|---|---|---|---|---|
| | | | | | 0dB | 7dB | ∞dB | 0dB | 7dB | ∞dB | | | | | | | | |
| | A | a | B | b | C | D | E | F | G | H | I | J | K | L | M | N | P | Q |
| 0 | 0 | 1 | 1 | 0 | 1 | 0 | 0 | 0 | 0 | 1 | 0 | 0 | 0 | 0 | 0 | 0 | 1 | 0 |
| 22.5 | 0 | 1 | 1 | 0 | 1 | 0 | 0 | 0 | 1 | 0 | 0 | 0 | 0 | 0 | 0 | 0 | 1 | 0 |
| 45 | 0 | 1 | 1 | 0 | 1 | 0 | 0 | 1 | 0 | 0 | 0 | 0 | 0 | 0 | 0 | 0 | 1 | 0 |
| 67.5 | 0 | 1 | 1 | 0 | 0 | 1 | 0 | 1 | 0 | 0 | 0 | 0 | 0 | 0 | 0 | 0 | 1 | 0 |
| 90 | 1 | 0 | 1 | 0 | 0 | 0 | 1 | 1 | 0 | 0 | 0 | 0 | 0 | 0 | 0 | 0 | 1 | 0 |
| 112.5 | 1 | 0 | 1 | 0 | 0 | 1 | 0 | 1 | 0 | 0 | 0 | 0 | 0 | 0 | 0 | 0 | 1 | 0 |
| 135 | 1 | 0 | 1 | 0 | 1 | 0 | 0 | 1 | 0 | 0 | 0 | 0 | 0 | 0 | 0 | 0 | 1 | 0 |
| 157.5 | 1 | 0 | 1 | 0 | 1 | 0 | 0 | 0 | 1 | 0 | 0 | 0 | 0 | 0 | 0 | 0 | 1 | 0 |
| 180 | 1 | 0 | 0 | 1 | 1 | 0 | 0 | 0 | 0 | 1 | 0 | 0 | 0 | 0 | 0 | 0 | 1 | 0 |
| 202.5 | 1 | 0 | 0 | 1 | 1 | 0 | 0 | 0 | 1 | 0 | 0 | 0 | 0 | 0 | 0 | 0 | 1 | 0 |
| 225 | 1 | 0 | 0 | 1 | 1 | 0 | 0 | 1 | 0 | 0 | 0 | 0 | 0 | 0 | 0 | 0 | 1 | 0 |
| 247.5 | 1 | 0 | 0 | 1 | 0 | 1 | 0 | 1 | 0 | 0 | 0 | 0 | 0 | 0 | 0 | 0 | 1 | 0 |
| 270 | 0 | 1 | 0 | 1 | 0 | 0 | 1 | 1 | 0 | 0 | 0 | 0 | 0 | 0 | 0 | 0 | 1 | 0 |
| 292.5 | 0 | 1 | 0 | 1 | 0 | 1 | 0 | 1 | 0 | 0 | 0 | 0 | 0 | 0 | 0 | 0 | 1 | 0 |
| 315 | 0 | 1 | 0 | 1 | 1 | 0 | 0 | 1 | 0 | 0 | 0 | 0 | 0 | 0 | 0 | 0 | 1 | 0 |
| 337.5 | 0 | 1 | 0 | 1 | 1 | 0 | 0 | 0 | 1 | 0 | 0 | 0 | 0 | 0 | 0 | 0 | 1 | 0 |

FIG. 9

| Azimuth Angle | Forward/Backward Switching | | | | Variable Attenuators | | | | | | Antenna 2a | | Antenna 2b | | Polarity Switching | | Band Switching | |
|---|---|---|---|---|---|---|---|---|---|---|---|---|---|---|---|---|---|---|
| | | | | | 0dB | 7dB | ∞dB | 0dB | 7dB | ∞dB | | | | | | | | |
| | A | a | B | b | C | D | E | F | G | H | I | J | K | L | M | N | P | Q |
| 0 | 0 | 0 | 0 | 0 | 1 | 0 | 0 | 0 | 0 | 1 | 0 | 0 | 0 | 0 | 1 | 0 | 0 | 1 |
| 22.5 | 0 | 0 | 0 | 0 | 1 | 0 | 0 | 0 | 1 | 0 | 0 | 0 | 0 | 0 | 1 | 0 | 0 | 1 |
| 45 | 0 | 0 | 0 | 0 | 1 | 0 | 0 | 1 | 0 | 0 | 0 | 0 | 0 | 0 | 1 | 0 | 0 | 1 |
| 67.5 | 0 | 0 | 0 | 0 | 0 | 1 | 0 | 1 | 0 | 0 | 0 | 0 | 0 | 0 | 1 | 0 | 0 | 1 |
| 90 | 0 | 0 | 0 | 0 | 0 | 0 | 1 | 1 | 0 | 0 | 0 | 0 | 0 | 0 | 0 | 1 | 0 | 1 |
| 112.5 | 0 | 0 | 0 | 0 | 0 | 1 | 0 | 1 | 0 | 0 | 0 | 0 | 0 | 0 | 0 | 1 | 0 | 1 |
| 135 | 0 | 0 | 0 | 0 | 1 | 0 | 0 | 1 | 0 | 0 | 0 | 0 | 0 | 0 | 0 | 1 | 0 | 1 |
| 157.5 | 0 | 0 | 0 | 0 | 1 | 0 | 0 | 0 | 1 | 0 | 0 | 0 | 0 | 0 | 0 | 1 | 0 | 1 |
| 180 | 0 | 0 | 0 | 0 | 1 | 0 | 0 | 0 | 0 | 1 | 0 | 0 | 0 | 0 | 1 | 0 | 0 | 1 |
| 202.5 | 0 | 0 | 0 | 0 | 1 | 0 | 0 | 0 | 1 | 0 | 0 | 0 | 0 | 0 | 1 | 0 | 0 | 1 |
| 225 | 0 | 0 | 0 | 0 | 1 | 0 | 0 | 1 | 0 | 0 | 0 | 0 | 0 | 0 | 1 | 0 | 0 | 1 |
| 247.5 | 0 | 0 | 0 | 0 | 0 | 1 | 0 | 1 | 0 | 0 | 0 | 0 | 0 | 0 | 1 | 0 | 0 | 1 |
| 270 | 0 | 0 | 0 | 0 | 0 | 0 | 1 | 1 | 0 | 0 | 0 | 0 | 0 | 0 | 0 | 1 | 0 | 1 |
| 292.5 | 0 | 0 | 0 | 0 | 0 | 1 | 0 | 1 | 0 | 0 | 0 | 0 | 0 | 0 | 0 | 1 | 0 | 1 |
| 315 | 0 | 0 | 0 | 0 | 1 | 0 | 0 | 1 | 0 | 0 | 0 | 0 | 0 | 0 | 0 | 1 | 0 | 1 |
| 337.5 | 0 | 0 | 0 | 0 | 1 | 0 | 0 | 0 | 1 | 0 | 0 | 0 | 0 | 0 | 0 | 1 | 0 | 1 |

FIG. 10

VARIABLE DIRECTIVITY ANTENNA APPARATUS AND RECEIVER SYSTEM USING SUCH ANTENNA APPARATUS

This invention relates to a variable directivity antenna apparatus having directivity which is variable, and to a receiver system using such variable directivity antenna apparatus.

BACKGROUND OF THE INVENTION

A variable directivity antenna is used to selectively receive radio waves coming from different directions. An example of such variable directivity antennas is disclosed in Japanese Utility Model Publication No. SHO 63-38574 (Y2) published on Oct. 12, 1988, assigned to the same assignee of the present application.

According to the technique disclosed in this UM publication, first and second antennas are disposed at right angles to each other in the same horizontal plane. The first and second antennas may be dipole antennas or folded-dipole antennas. A signal received by the first antenna is coupled through a first variable attenuator to a combiner, to which a signal received by the second antenna is also coupled through a second variable attenuator. The amounts of attenuation provided by the first and second variable attenuators are varied to change the directivity of the variable directivity antenna.

Because the directivity can be rotated, the variable directivity antenna of the Japanese UM publication can select and receive only a desired one of radio waves coming to the antenna from various directions. This antenna, however, has an 8-shaped directivity pattern, it also receives a radio wave coming to it from the direction opposite to the direction of the desired radio wave, and, therefore, its F/B ratio is low.

Therefore, an object of the present invention is to provide a small-sized antenna apparatus with an improved F/B ratio, which can selectively and satisfactorily receive radio waves coming to the antenna apparatus from different, two directions. Another object of the present invention is to provide a receiver system with a variable directivity antenna apparatus which can selectively and satisfactorily receive radio waves coming to the antenna from various directions.

SUMMARY OF THE INVENTION

A variable directivity antenna apparatus according to the present invention includes first and second antennas, which are adapted to receive radio waves in a first frequency band, e.g. a UHF band. Each of the first and second antennas exhibits an 8-shaped directivity pattern extending along a line perpendicular to the length of the antenna. The first and second antennas are disposed in parallel with each other with a spacing therebetween is approximately equal to or smaller than a quarter wavelength of the first frequency band. The variable directivity antenna apparatus also includes third and fourth antennas for receiving radio waves in the first frequency band. Each of the third and fourth antennas, too, exhibits an 8-chaped directivity pattern extending along a line perpendicular to the length of the antenna. The third and fourth antennas are disposed in parallel with each other with the same spacing therebetween as the one between the first and second antennas and perpendicularly to the first and second antennas. The first through fourth antennas may be, for example, dipole antennas or folded-dipole antennas.

Because of the spacing therebetween, the signal resulting from reception by the first antenna (hereinafter referred to the reception signal from the first antenna) of a radio wave coming from a first direction perpendicular to the first and second antennas, in which the radio wave arrives at the second antenna earlier than the first antenna, is provided with a phase delay relative to the reception signal resulting from reception by the second antenna (hereinafter referred to as the reception signal from the second antenna) of the radio wave coming from the first direction. On the other hand, the reception signal from the second antenna of a radio wave coming from an opposite, second direction perpendicular to the first and second antennas, in which the radio wave arrives at the first antenna earlier than the second antenna, is provided with a phase delay relative to the reception signal from the first antenna of the radio wave coming from the second direction. Similarly, the signal resulting from reception by the third antenna (hereinafter referred to as the reception signal from the third antenna) of a radio wave coming from a third direction perpendicular to the third and fourth antennas, in which the radio wave arrives at the fourth antenna earlier than the third antenna, is provided with a phase delay relative to the signal resulting from reception by the fourth antenna (hereinafter referred to as the reception signal from the fourth antenna) of the radio wave coming from the third direction. On the other hand, the reception signal from the fourth antenna of a radio wave coming from an opposite, fourth direction perpendicular to the third and fourth antennas, in which the radio wave arrives at the third antenna earlier than the fourth antenna, is provided with a phase delay relative to the reception signal from the third antenna of the radio wave coming from the fourth direction.

First phase adjusting means adjusts the phases of the reception signals from the first and second antennas and combines them into a combined signal having a selected one of a first directivity state corresponding to a directivity oriented to the first direction and a second directivity state corresponding to a directivity oriented to the second direction. For example, if the phase of one of the reception signals from the first and second antennas in the first frequency band coming from the second direction is adjusted such that the signals can be in substantially opposite phase, the combined signal can have the first directivity state because the reception signals resulting from receiving a radio wave from the second direction, when combined, are cancelled out, while the reception signals resulting from receiving a radio wave from the first direction, when combined, provide a resultant component. On the other hand, if the phase of one of the reception signals from the first and second antennas in the first frequency band coming from the first direction is adjusted such that the signals can be in substantially opposite phase, the combined signal can have the second directivity state because the reception signals resulting from receiving a radio wave from the first direction, when combined, are cancelled out, while the reception signals resulting from receiving a radio wave from the second direction, when combined, provide a resultant component.

Second phase adjusting means adjusts the phases of the reception signals from the third and fourth antennas and combines them into a combined signal having a selected one of a third directivity state corresponding to a directivity oriented to the third direction and a fourth directivity state corresponding to a directivity oriented to the fourth direction. For example, if the phase of one of the reception signals from the third and fourth antennas in the first frequency band coming from the fourth direction is adjusted such that the signals can be in substantially opposite phase, the combined signal can have the third directivity state because the reception signals resulting from receiving a radio wave from the fourth direction, when combined, are cancelled out, while the reception signals resulting from receiving a radio wave from the third direction, when combined, produce a resultant component. On the other hand, if the phase of one of the reception signals from the third and fourth antennas in the first frequency band coming from the third direction is adjusted such that the signals can be in substantially opposite phase, the combined signal can have the fourth directivity state because the reception signals resulting from receiving a radio wave from the third direction, when combined, are cancelled out, while the reception signals resulting from receiving a radio wave from the fourth direction, when combined, produce a resultant component.

Signal combining means adjusts the level of the first phase adjusting means output signal in the first or second directivity state and the level of the second phase adjusting means output signal in the third or fourth directivity state, and, then, combines the level-adjusted signals, so that the resulting output signal from the signal combining means can have directivity oriented to a selected one of the first through fourth directions and directions between adjacent ones of the first through fourth directions. The variable directivity antenna can exhibit directivity oriented to a selected one of sixteen (16) directions, for example.

The first phase adjusting means may operate to shift the phase of one of the reception signals from the first and second antennas by a predetermined amount in order to provide the combined, output signal with the first directivity state, and to shift the phase of the other one of the reception signals of the first and second antennas by the predetermined amount in order to provide the combined, output signal with the second directivity state. The second phase adjusting means may operate to shift the phase of one of the reception signals from the third and fourth antennas by a predetermined amount in order to provide the combined, output signal with the third directivity state, and to shift the phase of the other one of the reception signals from the third and fourth antennas by the predetermined amount in order to provide the combined, output signal with the fourth directivity state.

With the above-described arrangement of a variable directivity antenna apparatus according to the present invention, reception signals from the first and second antennas, which essentially exhibit an 8-shaped directivity pattern, are combined in the first phase adjusting means to exhibit directivity oriented to the first or second direction, before it is combined, in the signal combining means, with reception signals from the third and fourth antennas, which essentially exhibit an 8-shaped directivity pattern, combined in the second phase adjusting means to exhibit directivity oriented to the third or fourth direction. In this manner, the directivity of the variable directivity antenna apparatus is directed to a desired direction. Accordingly, the antenna apparatus can have an improved F/B ratio over a wide frequency band. One of the reception signals from the first and second antennas is phase-shifted by the first phase adjusting means, and one of the reception signals of the third and fourth antennas is phase-shifted by the second phase adjusting means. Since the amounts of phase shift provided by the first and second phase adjusting means are equal, the combining of the signals in the signal combining means is not affected by any phase difference, which leads no disturbance in directivity when the antenna directivity is directed in any directions other than the first through fourth directions.

The first phase adjusting means may include first combining means for combining reception signals from the first and second antennas, a first phase shifter, and first switching means for coupling the reception signal from the second antenna through the first phase shifter to the first combining means when the reception signal from the first antenna is being coupled to the first combining means and for coupling the reception signal from the first antenna through the first phase shifter to the first combining means when the reception signal from the second antenna is being coupled to the first combining means. In this case, the second phase adjusting means includes second combining means for combining reception signals of the third and fourth antennas, a second phase shifter providing the same amount of phase-shift as the first phase shifter, and second switching means for coupling the reception signal from the fourth antenna through the second phase shifter to the second combining means when the reception signal from the third antenna is being coupled to the second combining means and for coupling the reception signal from the third antenna through the second phase shifter to the second combining means when the reception signal from the fourth antenna is being coupled to the second combining means.

Alternatively, the first phase adjusting means may include third and fourth combining means having their outputs selectively outputted, the first phase shifter, and third switching means. The third switching means operates to cause the reception signal from the first antenna to be coupled to the third combining means and to cause the reception signal from the second antenna to be coupled to the third combining means through the first phase shifter when the output signal of the third combining means is selected. When the output signal of the fourth combining means is selected, the third switching means operates to cause the reception signal from the second antenna to be coupled to the fourth combining means and to cause the reception signal from the first antenna to be coupled through the first phase shifter to the fourth combining means. When the first phase adjusting means has such arrangement, the second phase adjusting means includes fifth and sixth combining means having their outputs selectively outputted, the second phase shifter providing the same amount of phase shift as the first phase shifter, and fourth switching means. The fourth switching means operates to cause the reception signal from the third antenna to be coupled to the fifth combining means and to cause the reception signal from the fourth antenna to be coupled to the fifth combining means through the second phase shifter when the output signal of the fifth combining means is selected. When the output signal of the sixth combining means is selected, the fourth switching means operates to cause the reception signal from the fourth antenna to be coupled to the sixth combining means and to cause the reception signal from the fifth antenna to be coupled through the second phase shifter to the sixth combining means.

With the above-described arrangement, the same, first phase shift means can be used for placing the antenna apparatus in either of the first and second directivity states, and, similarly, the same, second phase shift means can be used for placing the antenna apparatus in either third and fourth directivity states, which results in reduction of manufacturing costs.

The reception signals of the first and second antennas may be amplified by first and second amplifiers before being applied to the first phase adjusting means, with the reception signals of the third and fourth antennas amplified by third and fourth amplifiers before being applied to the second phase adjusting means. With this arrangement, the amplified signals are level-adjusted in the signal combining means, which results in improvement of the S/N ratio of the signal outputted from the signal combining means.

The first, second, third and fourth antennas may be dipole antennas. In this case, first and second extension elements are adapted to be connected to respective opposite outer ends of the first antenna through first and second switch elements, respectively. Third and fourth extension elements are adapted to be connected to respective opposite outer ends of the second antenna through third and fourth switch elements, respectively. Also, fifth and sixth extension elements are adapted to be connected to respective opposite outer ends of the third antenna through fifth and sixth switch elements, respectively, and seventh and eighth extension elements are adapted to be connected to respective opposite outer ends of the fourth antenna through seventh and eighth switch elements, respectively. The first and third switch elements are located on corresponding outer sides of the first and second antennas. For example, the first switch element is disposed at the outer end of one of the two dipole antenna elements of the first antenna corresponding to the outer end of the dipole element of the second antenna at which the third switch element is disposed. Similarly, the second and fourth switch elements are located on the corresponding, other outer sides of the first and second antennas. The fifth and seventh switch elements are located on corresponding outer sides of the third and fourth antennas, and the sixth and eighth switch elements are located on the corresponding, other outer sides of the third and fourth antennas. When the output signal of the signal combining means exhibits directivity oriented to a direction other than the first through fourth directions, either the first and third switch elements or the second and fourth switch elements, of the first and second antennas, are closed, and either the fifth and seventh switch elements or the sixth and eighth switch elements, of the third and fourth antennas, are closed.

With this arrangement, there is no disturbance in the directional characteristic of the variable directivity antenna apparatus when it exhibits directivity in a direction other than the first through fourth directions. Because the first and second antennas are spaced from each other by a distance smaller than a quarter of the wavelength of the first frequency band, the directivity exhibited is sharp in the first or second direction. For the same reason, the directivity exhibited by the third and fourth antennas is sharp in the third or fourth direction. Because of such sharp directivities, disturbances tend to occur in composite directivity in a direction other than the first through fourth directions, which results from combining the reception signals from the first and second antennas with the reception signals from the third and fourth antennas. In order to eliminate or reduce such disadvantage, desired one or more pairs of the extension elements located on the same sides of the respective antenna pairs are connected to the corresponding one or more pairs of the antennas. This causes the composite directivity of the first and second antennas to deviate from the first or second direction and causes the composite directivity of the third and fourth antennas to deviate from the third or fourth direction. After that the deviated composite directivity providing signals are further combined to reduce disturbance in the directivity.

The first antenna and the first and second extension elements, when connected, may be adapted to be capable of receiving radio waves in a second frequency band lower than the first frequency band, with the second antenna and the third and fourth extension elements, when connected, being adapted to be capable of receiving radio waves in the second frequency band. Also, when the fifth and sixth extension elements are connected to the third antenna, the third antenna can receive radio waves in the second frequency band. Similarly, the fourth antenna and the seventh and eighth extension elements, when connected, are adapted to be capable of receiving radio waves in the second frequency band. With this arrangement, the antenna apparatus can exhibit variable directivity for radio waves in the second frequency band.

Fifth and sixth antennas exhibiting an 8-shaped directivity may be additionally disposed in parallel between the first and second antennas and between the third and fourth antennas, respectively, for receiving radio waves in a third frequency band lower than the second frequency band. When receiving a radio wave in the third frequency band, reception signals of the fifth and sixth antennas are coupled to the signal combining means. With this arrangement, radio waves in the third frequency band, too, can be received with variable directivity.

The signal combining means may include first level adjusting means to which the output signal of the first phase adjusting means is applied, second level adjusting means to which the output of the second phase adjusting means is applied, and means for combing output signals of the first and second level adjusting means. In this case, each of the first and second level adjusting means is arranged to selectively assume a first factor state, a second factor state and a blocking state. In the first factor state, the signal inputted to each level adjusting means is outputted at a level proportional to a first factor. In the second factor state, the input signal is outputted at a level proportional to a second factor smaller than the first factor. In the blocking state, the input signal is blocked. The first and second level adjusting means are selectively placed in a first state in which the first level adjusting means is in the first factor state and the second level adjusting means is in the blocking state, in a second state in which the first level adjusting means is in the first factor state and the second level adjusting means is in the second factor state, in a third state in which both the first and second level adjusting means are in the second factor state, in a fourth state in which the first level adjusting means is in the second factor state and the second level adjusting means is in the first factor state, and in a fifth state in which the first level adjusting means is in the blocking state and the second level adjusting means is in the first factor state. This enables the antenna apparatus to exhibit directivity selectively in the sixteen directions.

The control in the first and second phase adjusting means may be provided in response to a control signal, and the level control in the signal combining means is also provided in response to the control signal. The variable directivity antenna apparatus is provided with control means, which provides the control signals. The control means prepares the control signals by demodulating a modulation signal, which is provided by a modulator through a transmission line through which the output signal of the signal combining means is transmitted to the receiver. The modulator produces the modulation signal by modulating a carrier with the control signal provided by predetermined control signal generating means. The modulator may employ any one of various modulating systems, including, but not limited to, phase-shift keying modulation, frequency-shift keying modulation, and amplitude-shift keying modulation, but the amplitude-shift keying modulation is desirous in view of simplicity of circuit arrangement.

A signal from another antenna may be combined with the output signal of the signal combining means. The composite signal is transmitted to the receiver through the transmission line.

The receiver may include a generator generating the control signals, reception state detecting means for detecting the reception state of a desired radio wave, and receiver control means for varying, when the reception state becomes unacceptable, the control signals to be supplied to the modulator from the control signal generator until the reception state as detected by the reception state detecting means becomes acceptable and supplies the control signals providing such acceptable reception state to the modulator.

BRIEF DESCRIPTION OF THE DRAWINGS

FIG. 8 illustrates directivity control in the UHF band of the antenna apparatus of FIG. 1.

FIG. 9 illustrates directivity control in a higher region of the VHF band of the antenna apparatus of FIG. 1.

FIG. 10 illustrates directivity control in a lower region of the VHF band of the antenna apparatus of FIG. 1.

DETAILED DESCRIPTION OF THE INVENTION

Figure 1:
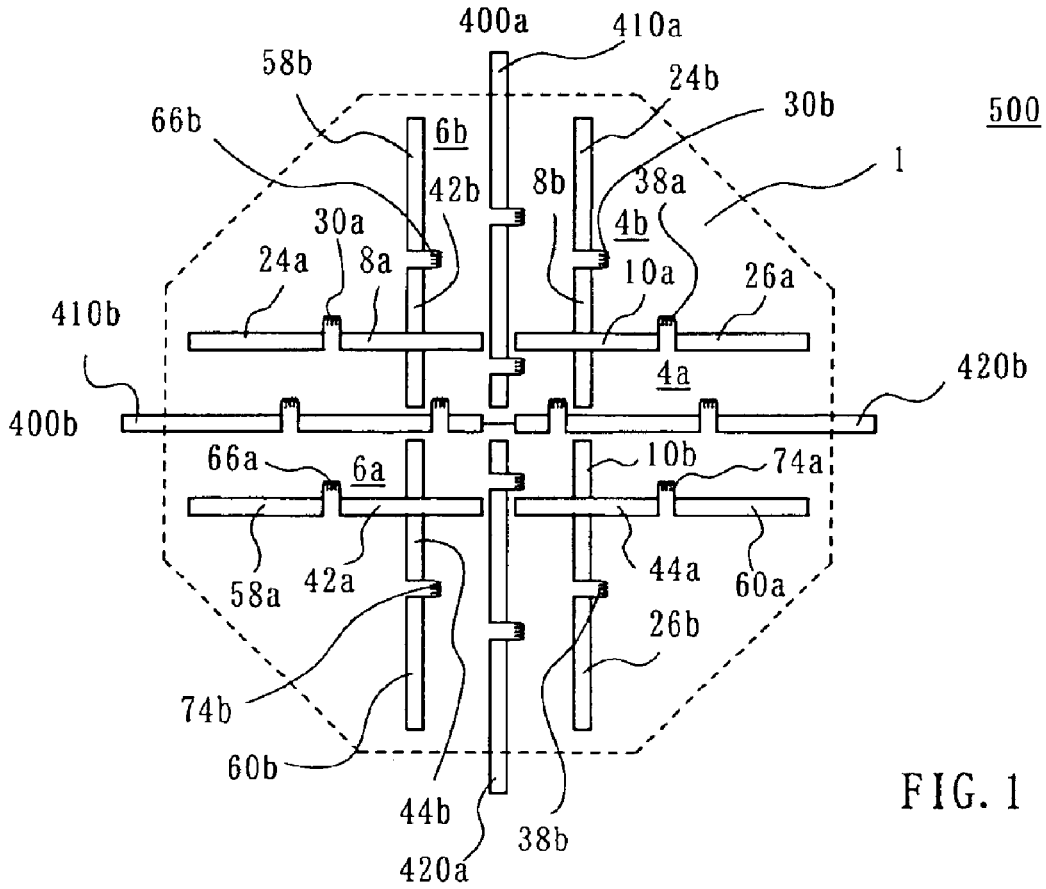
FIG. 1 is a plan view of a variable directivity antenna apparatus according to a first embodiment of the present invention.

Referring to FIG. 1, a variable directivity antenna apparatus 500 according to a first embodiment is capable of receiving radio waves in a first frequency band, e.g. the UHF band, radio waves in a second frequency band, e.g. the higher region of the VHF band (hereinafter referred to as VHFH), and radio waves in a third frequency band, e.g. the lower region of the VHF band (hereinafter referred to as VHFL). According to the present invention, radio waves in the UHF band may have frequencies of from 470 MHz to 890 MHz, for example, radio waves in the VHFL band may have frequencies of from 54 MHz to 88 MHz, for example, and radio waves in the VHFH band may have frequencies of from 170 MHz to 220 MHz, for example. The variable directivity antenna apparatus 500 has directivity which is variable in a plurality of steps at predetermined regular intervals, for example, in sixteen (16) steps at angular intervals of 22.5°.

Figure 2:
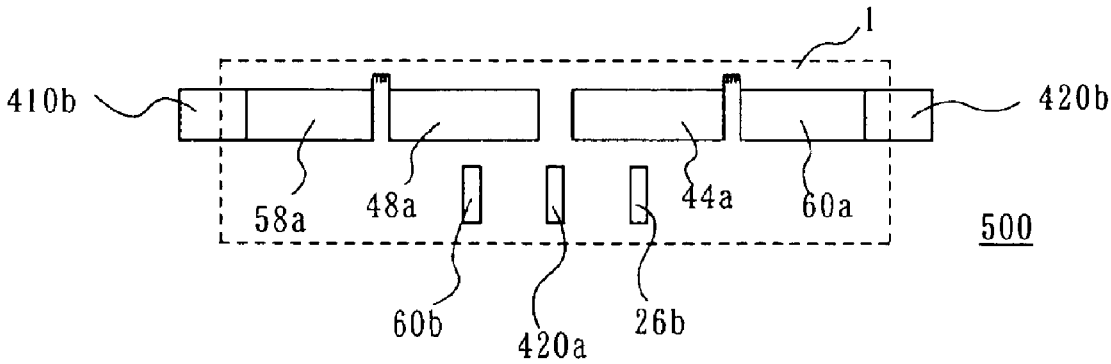
FIG. 2 is a front view of the antenna apparatus of FIG. 1.

The variable directivity antenna apparatus 500 has a main body 1, as shown in FIGS. 1 and 2. The main body 1 is generally octagonal in shape in plan.

Figure 3:
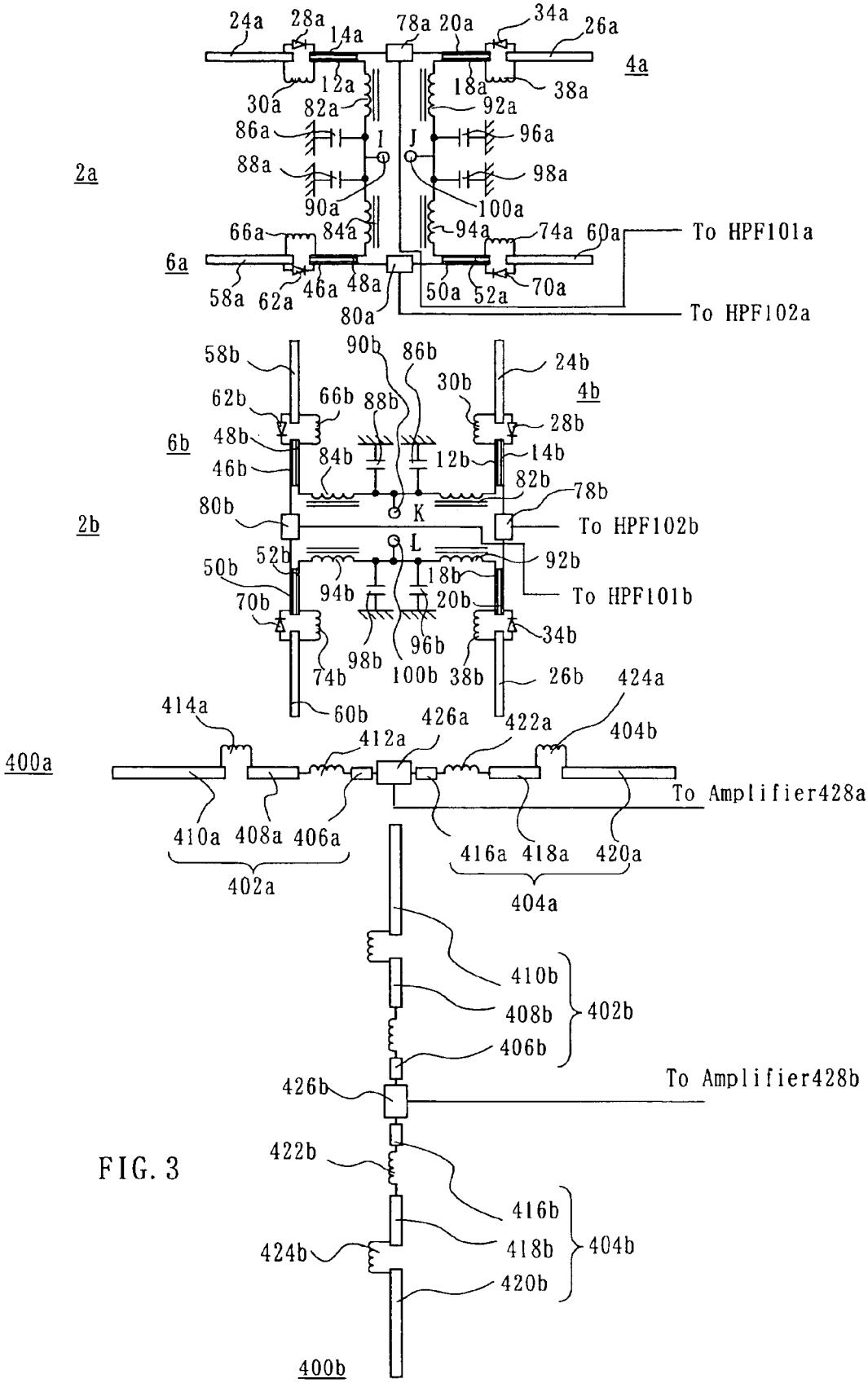
FIG. 3 shows in detail part of a circuit diagram of the antenna of FIG. 1.

Referring also to FIG. 3, the antenna apparatus 500 has a first and second frequency band receiving antenna device 2*a* for receiving both radio waves of the first frequency band and radio waves of the second frequency band. The antenna device 2*a* is disposed in the main body 1 and includes a first dipole antenna 4*a* and a second dipole antenna 6*a*.

The first dipole antenna 4*a* includes dipole antenna elements 8*a* and 10*a* disposed on the same straight line. The antenna elements 8*a* and 10*a* have the same length, which may be equal to, for example, about a quarter of a predetermined wavelength λ in the UHF band. The antenna element 8*a* includes two conductors 12*a* and 14*a* disposed in parallel with each other as shown in FIG. 3. Although not shown, a plurality of capacitors are disposed and connected between the conductors 12*a* and 14*a* at predetermined intervals to place the conductors 12*a* and 14*a* at the same potential in terms of high frequency. The dipole antenna element 10*a*, too, has two parallel conductors 18*a* and 20*a*, which are connected to each other by a plurality of capacitors (not shown) disposed between them at predetermined intervals so that they can be at the same potential in terms of high frequency. The total length of the first dipole antenna 4*a* including the dipole antenna elements 8*a* and 10*a* is about a half of the wavelength λ.

A first extension element 24*a* is disposed outward of the outer end of the dipole antenna element 8*a*, being aligned with the dipole antenna element 8*a*. Similarly a second extension element 26*a* is disposed outward of the outer end of the dipole antenna element 10*a*, being aligned with the dipole antenna element 10*a*. The sum of the length of the dipole antenna element 8*a* and the length of the extension element 24*a* is smaller than about a quarter of a predetermined wavelength in the VHF band, e.g. about a quarter of a predetermined wavelength λ in the VHFH band, and is not so long that the outer end of the extension element 24*a* would extend out of the main body 1. The sum length of the dipole antenna element 10*a* and the length of the extension element 26*a* is similarly selected. The dipole antenna elements 8*a* and 10*a* and the extension elements 24*a* and 26*a* may be formed on a single printed circuit board.

A switch element, for example, a PIN diode 28*a* is connected between the conductor 14*a* of the dipole antenna element 8*a* and the extension element 24*a* (FIG. 3). In the illustrated example, the anode of the PIN diode 28*a* is connected to the extension element 24*a*, while the cathode is connected to the conductor 14*a*. A DC path and switch element, e.g. a coil 30*a*, is connected between the conductor 12*a* and the extension element 24*a*. When a DC voltage is applied between the conductors 12*a* and 14*a* in such a polarity that the conductor 12*a* is positive and the conductor 14*a* is negative, the PIN diode 28*a* is rendered conductive. Then, the extension element 24*a*and the conductors 12*a* and 14*a* are electrically connected together. The conductors 12*a* and 14*a* are connected together in terms of high frequency. Thus, a parallel combination of the conductors 12*a* and 14*a* connected in parallel in terms of high frequency is connected in series with the extension element 24*a*. Without the DC voltage, the PIN diode 28*a* is nonconductive, the extension element 24*a* is disconnected in terms of high frequency from the parallel combination of the conductors 12*a* and 14*a*.

The value of the coil 30*a* is selected such that it can make the extension element 24*a* substantially decoupled from the conductors 12*a* and 14*a* at frequencies in the UHF band, make the extension element 24*a*substantially coupled to the conductors 12*a* and 14*a* at frequencies in the VHF band, and make the electrical sum length of the dipole antenna element 8*a* and the extension element 24*a* become about one quarter of the predetermined length λ of the VHF band. Then, even when the PIN diode 28*a* is nonconductive at frequencies of the VHF band, the extension element 24*a* and the conductors

12*a* and 14*a* are substantially connected together. The coil 30*a* functions as a loading coil in the VHFH band, which can make the sum length of the extension element 24*a* and the conductors 12*a*, 14*a* shorter than would be required if the coil 30*a* were not used.

Similarly, a PIN diode 34*a* and a coil 38*a* are connected between the extension element 26*a* and the conductors 18*a* and 20*a* of the dipole antenna element 10*a*. The length of the extension element 26*a* is selected in the same manner as the extension element 24*a*, and the value of the coil 30*a* is selected in the same manner as the coil 30*a*.

The second dipole antenna 6*a* is constructed similar to the first dipole antenna 4*a*, and includes dipole antenna elements 42*a* and 44*a*. The dipole elements 42*a* and 44*a* include a conductor pair 46*a* and 48*a* and a conductor pair 50*a* and 52*a*, respectively. The conductors 46*a* and 48*a* are connected together in terms of high frequency by means of a plurality of capacitors (not shown), and, also, the conductors 50*a* and 52*a* are connected together in terms of high frequency by means of a plurality of capacitors (not shown). Disposed outward of the outer ends of the dipole antenna elements 42*a* and 44*a* are extension elements 58*a* and 60*a*, respectively. A PIN diode 62*a* and a coil 66*a* are connected between the dipole antenna element 42*a* and the extension element 58*a*. Similarly, a PIN diode 70*a* and a coil 74*a* are connected between the dipole antenna element 44*a* and the extension element 60*a*. The lengths of the extension elements 58*a* and 60*a* are determined in the same manner as the extension elements 24*a* and 26*a*. The values of the coils 66*a* and 74*a* are selected in the same manner as the coils 30*a* and 38*a*.

The second dipole antenna 6*a* is disposed in the main body 1 and in parallel with the first dipole antenna 4*a* with a spacing therebetween smaller than a quarter of the wavelength λ of the UHF band.

The inner ends of the dipole antenna elements 8*a* and 10*a* of the first dipole antenna 4*a* are used as feed points. The inner ends of the conductors 14*a* and 20*a* are connected to a matching device, e.g. a balun 78*a*(FIG. 3). Similarly, the inner ends of the dipole antenna elements 42*a* and 44*a* of the second dipole antenna 6*a* are used as feed points, and the inner ends of the conductors 46*a* and 50*a* are connected to a matching device, e.g. a balun 80*a*. The baluns 78*a* and 80*a* are arranged such that the output of the balun 78*a* is 180°-out-of-phase with the output of the balun 80*a*.

High-frequency blocking coils 82*a* and 84*a* are connected in series between the conductors 12*a* and 48*a*, and a parallel combination of capacitors 86*a* and 88*a* is connected between the junction of the coils 82*a* and 84*a* and a point of reference potential, e.g. a point of ground potential. To the junction between the coils 82*a* and 84*a*, also connected is a voltage supply terminal 90*a*to which a positive voltage for rendering the PIN diodes 28*a* and 62*a* conductive is applied. Similarly, a series combination of high-frequency blocking coils 92*a* and 94*a* is connected between the conductors 18*a* and 52*a*, and a parallel combination of capacitors 96*a* and 98*a* is connected between the junction of the coils 92*a* and 94*a* and a point of ground potential. A voltage supply terminal 100*a* is connected at the junction of the coils 92*a* and 94*a*, for application of a positive voltage thereto for rendering the PIN diodes 34*a* and 70*a* conductive. The baluns 78*a* and 80*a* has grounded portions, and, therefore, when the positive voltage is applied to the voltage supply terminal 90*a* or 100*a*, current will flow from the baluns 78*a* and 80*a* to the ground potential point, and, the PIN diodes 28*a* and 62*a* or the PIN diodes 34*a* and 70*a* are made conductive.

A second antenna device 2*b* for receiving both radio waves in the first frequency band and radio waves in the second frequency band has substantially the same configuration as the first antenna device 2*a*. Therefore, the same reference numerals are used for components similar to the components of the first antenna device 2*a*, with a suffix "b" substituted for the suffix "a", and no detailed description is given. The second first and second frequency receiving antenna device 2*b* is disposed within the main body 1. The second antenna device 2*b* is spaced vertically from the first antenna device 2*a*, as shown in FIG. 2, with its center substantially coinciding with the center of the first antenna device 2*a*, and extends substantially orthogonal to the first antenna device 2*a*. The spacing between the third and fourth dipole antennas 4*b* and 6*b* is equal to the spacing between the first and second dipole antenna 4*a* and 6*a*.

As shown in FIG. 1, between the first and second dipole antennas 4*a* and 6*a* of the first antenna device 2*a*, a dipole antenna exclusively used for receiving radio waves in a third frequency band, e.g. a dipole antenna device 400*a* for the VHFL band is disposed. The VHFL band dipole antenna 400*a* is disposed in parallel with the first and second dipole antenna 4*a* and 6*a*, and includes dipole antenna elements 402*a* and 404*a* as shown in FIG. 3.

The dipole antenna elements 402*a* includes plural elements, e.g. three elements 406*a*, 408*a* and 410*a*, which are disposed on a straight line with a minute spacing disposed between each other. The lengths of the elements 406*a*, 408*a* and 410*a* are so selected that any of them function as none of a director, a reflector or a radiator for the UHF band receiving dipole antennas 4*a* and 6*a* when they receive UHF band waves. The lengths may be, for example, from about 0.15 λ to about 0.3 λ. The outer end of the element 410*a* extends out of the main body 1. For that purpose, the element 410*a* is a metal sheet housed in a plastic case, but it may be in the form of pipe formed of aluminum or stainless steel. The other elements 406*a* and 408*a* are located within the main body 1, and, therefore, they can be formed on a printed circuit board, but they may be in the form of metal sheet.

The elements 406*a* and 408*a* are connected to each other by a coil 412*a*, and the elements 408*a* and 410*a* are connected together by a coil 414*a*. The coils 412*a* and 414*a* have such inductance that they can function as extension coils to make the sum length of the elements closer to a quarter of the wavelength of a radio wave at a predetermined frequency in the VHFL band, and can exhibit such high impedance in the UHF and VHFH bands as to electrically separate the elements 406*a*, 408*a* and 410*a* from each other.

The dipole antenna element 404*a* also includes elements 416*a*, 418*a* and 420*a*, which are equivalent to the elements of the dipole antenna element 402*a*. Coils 422*a* and 424*a* are connected between the elements 416*a* and 418*a* and between the elements 418*a* and 420*a*, respectively. The inductance values of the coils 422*a* and 424*a* are equal to those of the coils 412*a* and 414*a*, respectively.

A VHFL band receiving dipole antenna 400*b* is disposed between the first and second dipole antennas 4*b* and 6*b* of the first and second frequency band receiving antenna device 2*b* (FIG. 1). The configuration and arrangement of the dipole antenna 400*b* is the same as that of the dipole antenna 400*a* except that it is disposed orthogonal to the dipole antenna 400*a* with its center coinciding with that of the dipole antenna 400*a*. Accordingly, the same reference numerals with a suffix "b" substituted for the suffix "a" as used for the components of the dipole antenna 400*a* are used for the same or equivalent components of the dipole antenna 400*b*, and no detailed description is made.

The inner ends of the dipole antenna elements 402*a* an 404*a* are used as feed points, and coupled to a matching device, e.g. a balun 426*a*. Similarly, the inner ends of the dipole antenna elements 402*b* and 404*b*, acting as feed points, are coupled to a matching device, e.g. a balun 426*b*.

The VHFL band receiving dipole antenna 400*a* exhibits an 8-shaped directivity pattern extending in a direction perpendicular to its length direction. Let four directions, forward, backward, leftward and right ward directions, be considered such that the side of the antenna apparatus 500 to which the dipole antenna 4*a* is located nearer is the forward side, the side to which the dipole antenna 6*a* is located nearer is the backward side, the side to which the dipole antenna 4*b* is located nearer is the right side, and the side to which the dipole antenna 6*b* is located nearer is the left side of the antenna. Then, the VHFL band dipole antenna 400*a* exhibits an 8-shaped directivity along the forward-backward direction, while the VHFL band dipole antenna 400*b* exhibits an 8-shaped directivity along the left-right direction.

Figure 4:
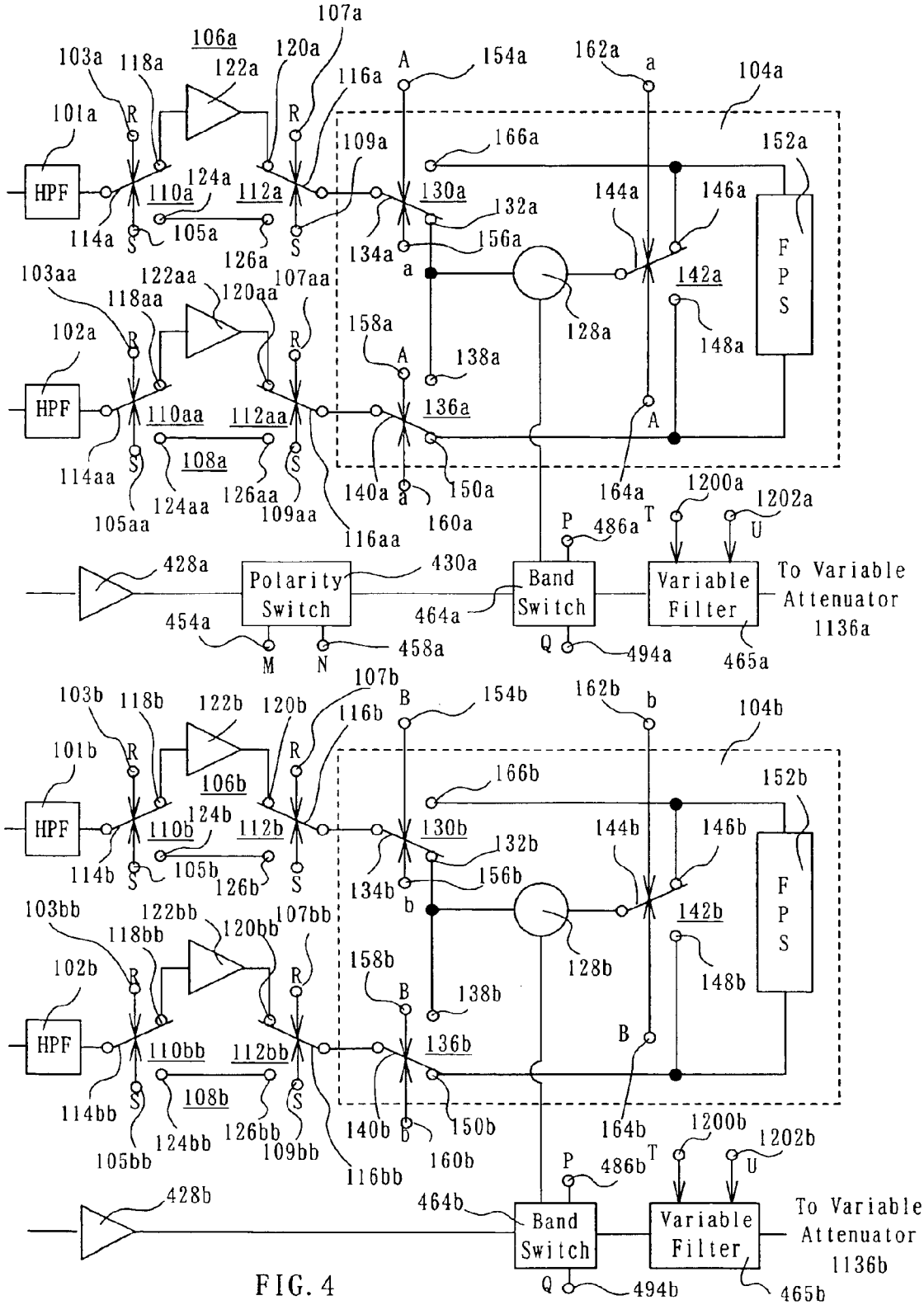
FIG. 4 shows in detail other part of the circuit diagram of the antenna apparatus of FIG. 1.

Referring to FIGS. 3 and 4, output signals of the baluns 78*a* and 80*a* of the antenna device 2*a* are coupled to a phase adjusting circuit 104*a* through high-pass filters 101*a* and 102*a*, which are located within the main body 1. The high-pass filters 101*a* and 102*a* have a cutoff frequency such as to pass high-frequency signals in the VHFH and UHF bands therethrough. A variable amplifier 106*a* is connected between the high-pass filter 101*a* and the phase adjusting circuit 104*a*, and a variable amplifier 108*a* is connected between the high-pass filter 102*a* and the phase adjusting circuit 104*a*. The variable amplifier 106*a* includes changeover switches 110*a* and 112*a* having movable contacts 114*a* and 116*a*, respectively. When the movable contacts 114*a* and 116*a* are connected to contacts 118*a* and 120*a*, the output signal of the high-pass filter 101*a* is coupled to and amplified in an amplifier 122*a*. On the other hand, when the movable contacts 114*a* and 116*a* are connected to contacts 124*a* and 126*a*, the output signal of the high-pass filter 101*a* is outputted, being unmodified. The changeover switches 110*a* and 112*a* are semiconductor switches, and may be formed of PIN diodes. With a positive voltage applied to a voltage supply terminal 103*a*, the movable contact 114*a* of the switch 110*a* is brought into contact with the contact 118*a*. The movable contact 114*a* is brought into contact with the contact. 124*a* when a positive voltage is applied to a voltage supply terminal 105*a*. The movable contact 116*a* of the switch 112*a* is connected to the contact 120*a* when a positive voltage is applied to a voltage supply terminal 107*a*, and is connected to the contact 126*a* when a positive voltage is applied to a voltage supply terminal 109*a*. A voltage R is applied synchronously to the voltage supply terminals 103*a* and 107*a*, and a voltage S is applied synchronously to the voltage supply terminals 105*a* and 109*a*. When the voltage R is positive and the voltage S is not positive, the variable amplifier 106*a* performs amplifying operation as described above. When the voltage R is not positive and the voltage S is positive, the variable amplifier 106*a* does not perform amplifying operation.

Similarly, the output signal of the high-pass filter 102*a* is either amplified or not amplified in the variable amplifier 108*a* before being applied to the phase adjusting circuit 104*a*. The circuit arrangement of the variable amplifier 108*a* is the same as that of the variable amplifier 106*a*. Therefore the same suffixed reference numerals used for the components of the amplifier 106*a* is attached to the components equivalent to those of the amplifier 108*a* with an additional suffix "a" attached, and no further detailed description about them is given.

When the reception level of a UHF or VHFH band radio wave to be received by the variable directivity antenna apparatus described above is low, the output signals of the high-pass filters 101*a* and 102*a* are amplified in the variable amplifiers 106*a* and 108*a*, respectively. Changeover switches and combiners in the stage succeeding the variable amplifiers 106*a* and 108*a* may give attenuation to signals, but the amplification by the amplifiers 106*a* and 108*a* can improve the S/N ratio of the antenna apparatus.

The phase adjusting circuit 104*a* includes first combining means, e.g. a combiner 128*a*. A first input of the combiner 128*a* is connected to switching means, e.g. one contact 132*a* of a changeover switch 130*a*, which has a movable arm 134*a* connected to the output of the variable amplifier 106*a*. The first input of the combiner 128*a* is also connected to switching means, e.g. to a contact 138*a* of a changeover switch 136*a* having its movable arm connected to the output of the variable amplifier 108*a*.

The other, second input of the combiner 128*a* is connected to a movable arm 144*a* of a changeover switch 142*a*. The switch 142*a* has a contact 146*a* connected to a contact 166*a* of the changeover switch 130*a*. The switch 142*a* has another contact 148*a* connected to a contact 150*a* of the changeover switch 136*a*.

A phase shifter, e.g. a fixed phase shifter (FPS) 152*a*, is connected between the contacts 146*a* and 148*a* of the changeover switch 142*a*. The fixed phase shifter 152*a* may be formed of, for example, a delay line, more specifically, a coaxial cable or a microstrip line.

The changeover switches 130*a*, 136*a* and 142*a* are formed of semiconductor switches, such as PIN diodes, like band switching sections 464*a* and 464*b* which will be described later, and include voltage supply terminals 154*a*, 156*a*, 158*a*, 160*a*, 162*a* and 164*a*, to which a positive voltage may be applied as a control signal.

When a positive voltage is applied to the voltage supply terminal 154*a* and a positive voltage is not applied to the voltage supply terminal 156*a*, the movable arm 134*a* of the changeover switch 130*a* is connected to the contact 166*a*, and, when a positive voltage is not applied to the voltage supply terminal 154*a* and a positive voltage is applied to the voltage supply terminal 156*a*, the movable arm 134*a* of the changeover switch 130*a* is connected to the contact 132*a*.

When a positive voltage is applied to the voltage supply terminal 158*a* and a positive voltage is not applied to the voltage supply terminal 160*a*, the movable arm 140*a* of the changeover switch 136*a* is connected to the contact 138*a*, and, when a positive voltage is not applied to the voltage supply terminal 158*a* and a positive voltage is applied to the voltage supply terminal 160*a*, the movable arm 140*a* of the changeover switch 136*a* is connected to the contact 150*a*.

When a positive voltage is applied to the voltage supply terminal 162*a* and a positive voltage is not applied to the voltage supply terminal 164*a*, the movable arm 144*a* of the changeover switch 142*a* is connected to the contact 146*a*, and, when a positive voltage is not applied to the voltage supply terminal 162*a* and a positive voltage is applied to the voltage supply terminal 164*a*, the movable arm 144*a* of the changeover switch 142*a* is connected to the contact 148*a*.

A voltage A is synchronously applied to the voltage supply terminals 154*a*, 158*a* and 164*a*, and a voltage a is synchronously applied to the voltage supply terminals 156*a*, 160*a* and 162*a*. When the voltage A is positive, the voltage a is not positive, and vice versa.

Thus, when the voltage A is not positive and the voltage a is positive, the movable arm 134*a* of the changeover switch 130*a* is connected to the contact 132*a*, the movable contact 140*a* of the changeover switch 136*a* is connected to the contact 150*a*, and the movable contact 144*a* of the changeover switch 142*a* is connected to the contact 146*a*, as illustrated in FIG. 4. When the voltage A is positive and the voltage a is not positive, the movable arm 134*a* of the changeover switch 130*a* is connected to the contact 166*a*, the movable contact 140*a* of the changeover switch 136*a* is connected to the contact 138*a*, and the movable contact 144*a* of the changeover switch 142*a* is connected to the contact 148*a*.

When the voltage a is positive, the combiner 128*a* receives an unmodified version of the output signal of the balun 78*a*, and receives the output signal of the balun 80*a* through the fixed phase shifter 152*a*. On the other hand, when the voltage A is positive, the combiner 128*a* receives the output signal of the balun 78*a* through the fixed phase shifter 152*a* and receives an unmodified version of the output signal of the balun 80*a*.

Now, let it be assumed that the dipole antenna 4*a* is facing forward of the antenna apparatus 500, while the dipole antenna 6*a* is facing backward, and that all of the switches are opened. A UHF band radio wave coming to the antenna apparatus from the backward direction is received by the dipole antennas 4*a* and 6*a* and causes an output to be developed at each of the baluns 78*a* and 80*a*. The reception signal resulting from reception of the radio wave by the forward dipole antenna 4*a* is delayed by an amount D due to the spacing (less than a quarter of λ) between the dipole antennas 4*a* and 6*a*, relative to the reception signal resulting from the reception of the radio wave by the backward dipole antenna 6*a*. Further, the balun 78*a* is configured to invert the phase of the signal from the antenna 4*a* by 180°. More specifically, the output signal of the balun 78*a* has a phase difference equal to (−λ/2)−D relative to the output signal of the balun 80*a*. When the voltage a is made positive, the states of the changeover switches 130*a*, 136*a* and 142*a* are switched into the states shown in FIG. 4, causing the output signal of the balun 78*a* to be applied, as it is, to the combiner 128*a*. On the other hand, the output signal of the balun 80*a* is delayed by a predetermined amount of delay D1 in the fixed phase shifter 152*a*, or, in other words, is given a phase difference equal to −D1 relative to the output signal of the balun 80*a*, before being applied to the combiner 128*a*. It should be noted that the delay amount D1 is chosen to make the difference between −D1 and (−λ/2)−D equal to about λ/2. In other words, the amount of delay D1 is set to D. Accordingly, the reception signals of the dipole antennas 4*a* and 6*a* resulting from reception of a radio wave coming from the backward direction are applied to the inputs of the combiner 128*a* in substantially opposite phase. It means that the antenna apparatus 500 does not exhibit backward directivity. In other words, the first antenna device 2*a* formed of the dipole antennas 4*a* and 6*a* becomes an antenna device exhibiting a forward directivity but not exhibiting a backward directivity.

The output signal of the balun 80*a* corresponding to the reception signal from the dipole antenna 6*a* resulting from receiving a UHF radio wave coming from the forward direction is delayed by D from the reception signal from the dipole antenna 4*a* of the same radio wave. Due to the arrangement of the balun 78*a*, the output signal of the balun 78*a* is in 180°-out-of-phase with the reception signal from the dipole antenna 4*a*. Thus, the output signal of the balun 78*a* has a phase difference equal to −λ/2 relative to the reception signal from the dipole antenna 4*a*, and the output signal of the balun 80*a* has a phase difference equal to −D relative to the reception signal from the dipole antenna 4*a*.

When the voltage A is made positive, the movable arm 134*a* of the switch 130*a* is brought into contact with the contact 166*a*, the movable arm 140*a* of the switch 136*a* is brought into contact with the contact 138*a*, and the movable arm 144*a* of the switch 142*a* is brought into contact with the contact 148*a*, so that the output signal of the balun 78*a* is applied to the combiner 128*a*after being delayed by the fixed phase shifter 152*a*, while the output signal of the balun 80*a* is applied, as it is, to the combiner 128*a*. Since the output signal of the balun 78*a* is delayed by the amount D in the fixed phase shifter 152*a*, the phase of the output signal of the balun 78*a* at the combiner 128*a* is (−λ/2)−D, resulting in a phase difference of −λ/2 relative to the phase −D of the output signal of the balun 80*a*. This means that the first antenna device 2*a* has a backward directivity, but not a forward directivity.

As described above, by making the voltage a positive, the antenna device can exhibit a forward directivity, and by making the voltage A positive, the antenna device 2*a* can exhibit a backward directivity.

As described above, the same fixed phase shifter 152*a* is used in the phase adjusting circuit 104*a* for causing the antenna device 2*a* to exhibit either of a forward directivity and a backward directivity.

The reception signals of the antenna device 2*b* are processed in the phase adjusting circuit 104*b* in a manner similar to the one described above for the antenna device 2*a* so that the antenna device 2*b* can exhibit either a rightward directivity or a leftward directivity. The structure of the phase adjusting circuit 104*b* is the same as that of the phase adjusting circuit 104*a*, the components of the phase adjusting circuit 104*b* are given the same reference numerals as the ones attached to the corresponding components of the phase adjusting circuit 104*a*, with a suffix "b" substituted for the suffix "a", and no further detailed description is made. It should be noted, however, the output signal of the balun 80*b* is applied to the high-pass filter 101*b*, and the output signal of the balun 78*b* is applied to the high-pass filter 102*b*. The amount of delay provided by the fixed phase shifter 152*b* is equal to the delay amount provided by the fixed phase shifter 152*a*.

Figure 5:
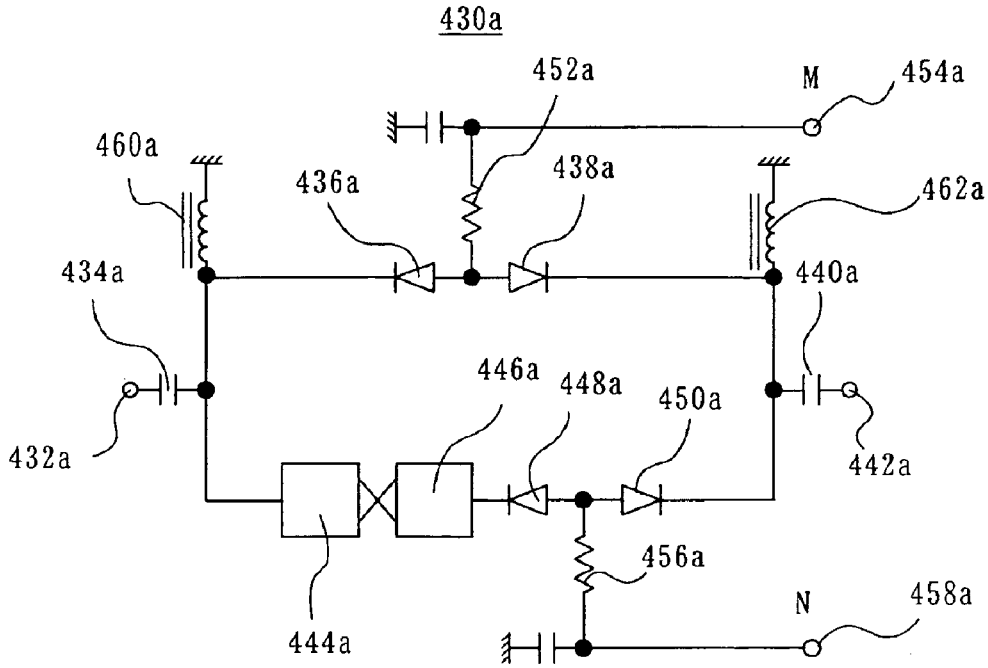
FIG. 5 is a circuit diagram of a polarity switching section used in the antenna apparatus of FIG. 1.

As shown in FIG. 3, the output signal of the balun 426*a* of the VHFL band dipole antenna 400*a* is amplified by an amplifier 428 disposed in the main body 1 before being applied to a polarity switching section 430*a*. The polarity switching section 430*a*, as exemplified in FIG. 5, has an input terminal 432*a* connected to a non-inverting circuit through a DC blocking capacitor 434*a*. The non-inverting circuit includes switching devices, e.g. PIN diodes 436*a* and 438*a*. The PIN diode 436*a* has its cathode connected to the DC blocking capacitor 434*a* and has its anode connected to the anode of the PIN diode 438*a*. The PIN diode 438*a* has its cathode connected through a DC blocking capacitor 440*a* to an output terminal 442*a*. Thus, when the PIN diodes 436*a* and 438*a* are conductive, the signal from the amplifier 428*a* applied to the input terminal 432*a* is developed, as it is, at the output terminal 442*a*.

The polarity switching section 430*a* includes also an inverting circuit, which includes a balun 444*a* connected through the DC blocking capacitor 434*a* to the input terminal 432*a*. The polarity of the signal at the output of the balun 444*a* is inverted before being applied to another balun 446*a*. The output of the balun 446*a* is connected through switching devices, e.g. PIN diodes 448*a* and 450*a*, and the DC blocking capacitor 440*a*, to the output terminal 442*a*. More specifically, the PIN diode 448*a* has its cathode connected to the output of the balun 446*a* and has its anode connected to the anode of the PIN diode 450*a*, of which the cathode connected to the DC blocking capacitor 440*a*. Thus, when the PIN diodes 448*a* and 450*a* are rendered conductive, the signal applied to the input terminal 432*a* from the amplifier 428*a* is inverted in polarity by the baluns 444*a* and 446*a* and outputted through the PIN diodes 448*a* and 450*a* to the output terminal 442*a*.

In order to control the PIN diodes 436*a* and 438*a*, the junction of their anodes is connected through a resistor 452*a* to a voltage supply terminal 454*a*, and, in order to control the PIN diodes 448*a* and 450*a*, the junction of their anodes is connected through a resistor 456*a* to a voltage supply terminal 458*a*. Also, high-frequency blocking coils 460*a* and 462*a* are used so that the PIN diodes 436*a*, 438*a*, 448*a* and 450*a* become conductive when voltages are supplied to the voltage supply terminals 454*a* and 458*a*.

Figure 6:
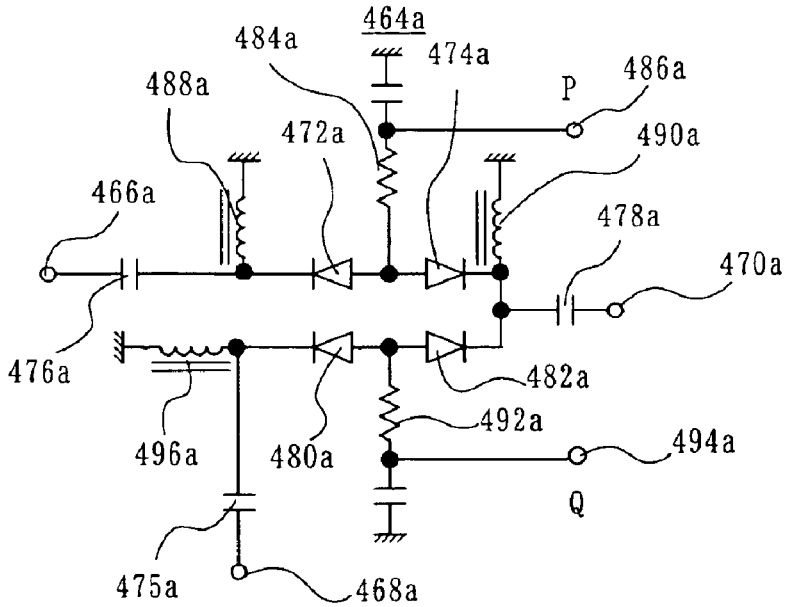
FIG. 6 is a circuit diagram of a band switching section used in the antenna apparatus of FIG. 1.

As shown in FIG. 4, a signal from the polarity switching section 430*a*, i.e. a VHFL signal, and a signal from the combiner 128*a*, i.e. a VHFH or UHF signal, are applied to a band switching section 464*a*. As shown in FIG. 6, the band switching section 464*a* has an input terminal 466*a*, to which the signal from the combiner 128*a* is coupled, and an input terminal 468*a*, to which the signal from the polarity switching section 430*a* is applied. Between the input terminal 466*a* and an output terminal 470*a* of the band switching section 464*a*, switching means, e.g. PIN diodes 472*a* and 474*a* are connected. The PIN diode 472*a* has its cathode connected through a DC blocking capacitor 476*a* to the input terminal 466*a* and has its anode connected to the anode of the PIN diode 474*a*. The PIN diode 474*a* has its cathode connected through a DC blocking capacitor 478*a* to the output terminal 470*a*. Similarly, switching means, e.g. PIN diodes 480*a* and 482*a* are connected between the input terminal 468*a* and the output terminal 470*a*. The PIN diode 480*a* has its cathode connected through a DC blocking capacitor 475*a* to the input terminal 468*a* and has its anode connected to the anode of the PIN diode 482*a*. The PIN diode 482*a* has its cathode connected through the DC blocking capacitor 478*a* to the output terminal 470*a*. In order to render the PIN diodes 472*a* and 474*a* conductive, a resistor 484*a*, a voltage supply terminal 486*a*, and high-frequency blocking coils 488*a* and 490*a* are used. Also, in order to render the PIN diodes 480*a* and 482*a* conductive, a resistor 492*a*, a voltage supply terminal 494*a*, a high-frequency blocking coil 496*a* and the high-frequency blocking coil 490*a* are used.

When the PIN diodes 472*a* and 474*a* are conductive, the VHFH or UHF signal supplied from the combiner 128*a* to the input terminal 466*a* appears at the output terminal 470*a*, whereas, when the PIN diodes 480*a* and 482*a* are conductive, the VHFL signal supplied from the band switching section 430*a* to the input terminal 468*a* appears at the output terminal 470*a*.

In the variable directivity antenna 500, as shown in FIGS. 3 and 4, the output signal of the balun 426*b* of the VHFL band dipole antenna 400*b* is amplified in the amplifier 428*b* in the main body 1 before being applied to the band switching section 464*b*. The band switching section 464*b* is configured similar to the band switching section 464*a*, and its detailed description is not made. The output signals of the band switching sections 464*a* and 464*b* are applied to level adjusting means, e.g. variable attenuators 1136*a* and 1136*b* (shown in FIG. 7), respectively, through variable bandpass filters 465*a* and 465*b*. The variable bandpass filter 465*a* has voltage supply terminals 1200*a* and 1202*a*, and the variable bandpass filter 465*b* has voltage supply terminals 1200*b* and 1202*b*. When a H-level voltage is applied to the voltage supply terminals 1200*a* and 1200*b*, they pass a high-frequency signal in the UHF band therethrough, and, when a H-level voltage is applied to the voltage supply terminals 1202*a* and 1202*b*, they pass a high-frequency signal in the VHF band therethrough.

When the variable bandpass filters 465*a* and 465*b* are developing UHF or VHFH signals with forward or backward directivity, a signal with a desired directivity can be obtained by appropriately selecting the directivity of the UHF or VHFH signals provided by the variable bandpass filters 465*a* and 465*b*, appropriately adjusting the levels of these signals in the variable attenuators 1136*a* and 1136*b*, respectively, and combining them. Similarly, when the band switching sections 464*a* and 464*b* are developing VHFL signals with an 8-shaped directivity, the 8-shaped directivity can be oriented in a desired direction by appropriately selecting the polarities of these signals, appropriately adjusting the levels of these signals in the variable attenuators 1136*a* and 1136*b*, and combining them.

For that purpose, the variable attenuators 1136*a* and 1136*b* are configured such as to provide an amount of attenuation selectable from plural amounts, e.g. three values, namely, 0 dB, 7 dB and infinity (∞). The directivity of the resultant signal can be adjusted to directions at predetermined intervals from the forward direction (0°), for example, in sixteen (16) directions angularly spaced by 22.5°, by adjustment of directivities of the signals, and the adjustment of the amounts of attenuation in the variable attenuators 1136*a* and 1136*b*, for the UHF or VHFH band signal, and by the adjustment of polarities and the adjustment of the amounts of attenuation in the variable attenuators 1136*a* and 1136*b* for the VHFL band signal.

Figure 7:
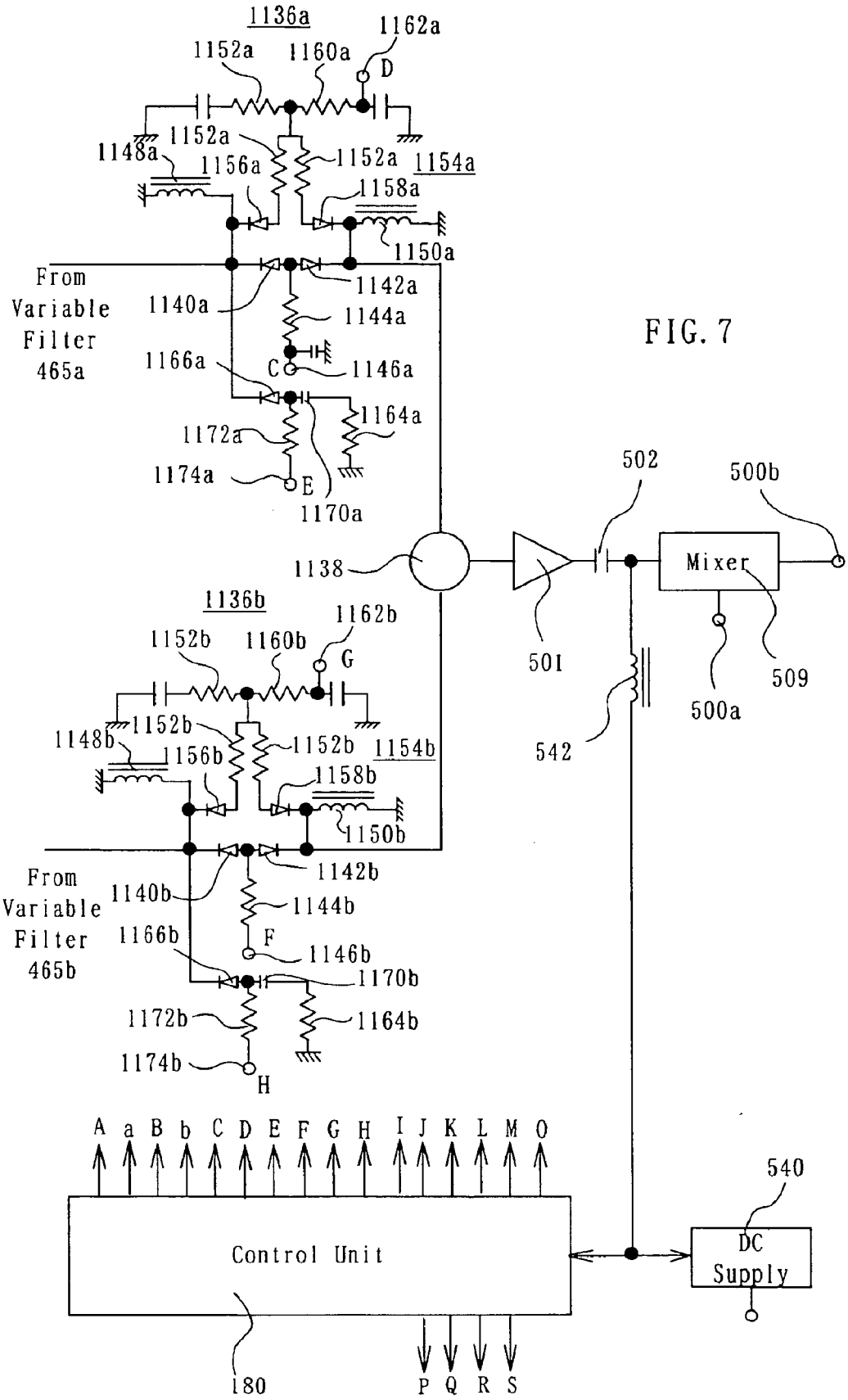
FIG. 7 is a circuit diagram of the remaining part of the antenna apparatus of FIG. 1.

For that purpose, the variable attenuator 1136*a* has a series combination of switching devices, e.g. PIN diodes 1140*a* and 1142*a* connected between the variable bandpass filter 465*a* and a combiner 1138 as shown in FIG. 7. The PIN diode 1140*a* has its cathode connected to the output of the band switching section 464*a*, and has its anode connected to the anode of the PIN diode 1142*a*, which has its cathode connected to an input of the combiner 1138. The junction of the anodes of the PIN diodes 1140*a* and 1142*a* is connected through a resistor 1144*a* to a voltage supply terminal 1146*a*. The cathodes of the PIN diodes 1140*a* and 1142*a* are connected respectively through high-frequency blocking coils 1148*a* and 1150*a* to a point of reference potential. Accordingly, when a positive voltage is applied to the voltage supply terminal 1146*a*, the PIN diodes 1140*a* and 1142*a* become conductive, so that the signal from the variable filter 465*a* is coupled to the combiner 1138 without being attenuated.

The variable attenuator 1136*a* also includes a fixed amount attenuator, e.g. a T-type attenuator 1154*a*. The attenuator 1154*a* includes three resistors 1152*a* and provides an amount of attenuation of 7 dB. A switching device is connected to the input of the attenuator 1154*a*. For example, the anode of a PIN diode 1156*a* is connected to the input of the attenuator 1154*a*. The cathode of the PIN diode 1156*a* is connected to the cathode of the PIN diode 1140*a*. A switching device is connected to the output of the attenuator 1154*a*. More specifically, the anode of a PIN diode 1158*a*, for example, is connected to the output of the attenuator 1154*a*. The cathode of the PIN diode 1158*a* is connected to the cathode of the PIN diode 1142*a*. The junction of the three resistors 1152*a* of the T-type attenuator 1154*a* is connected through a resistor 1160*a* to a voltage supply terminal 1162*a*. With this arrangement, when a positive voltage is applied to the voltage supply terminal 1162*a*, the PIN diodes 1156*a* and

1158*a* are rendered conductive, causing the T-type attenuator 1154*a* to be connected between the variable filter 465*a* and the combiner 1138, so that the signal from the variable filter 465*a* is provided with an attenuation of 7 dB.

The variable attenuator 1136*a* further includes a matching resistor 1164*a* having an impedance equal to the impedance of the first antenna device 2*a*. The resistor 1164*a* has its one end connected to a point of reference potential and has its other end connected through a DC blocking capacitor 1170*a* to a switching device, e.g. a PIN diode 1166*a*. The anode of the PIN diode 1166*a* is connected to the DC blocking capacitor 1170*a*. The cathode of the PIN diode 1166*a* is connected to the cathode of the PIN diode 1140*a*. The anode of the PIN diode 1166*a* is also connected through a resistor 1172*a* to a voltage supply terminal 1174*a*. With this arrangement, when a positive voltage is applied to the voltage supply terminal 1174*a*, the PIN diode 1166*a* is rendered conductive, causing the output of the variable filter 465*a* to be connected through the matching resistor 1164*a* to a point of reference potential, so that the signal from the variable filter 465*a* is given attenuation of infinite magnitude.

The variable attenuator 1136*b* is configured similar to the variable attenuator 1136*a*, and, therefore, its detailed description is not given. The components of the attenuator 1136*b* corresponding to those of the attenuator 1136*a* are given the same reference numerals as given to those of the attenuator 1136*a*, with an exception that a suffix "b" is substituted for the suffix "a".

In order to vary the directivity of the variable directivity antenna 500, a control unit 180 is provided as shown in FIG. 7. The control unit 180 operates to produce a control signal by demodulating a modulation signal supplied by a receiver apparatus 518, which will be described later. In accordance with the demodulated control signal, the control unit 180 provides respective voltages, as shown in FIGS. 8, 9 and 10, to the voltage supply terminals 90*a*, 90*b*, 100*a*, 100*b*, 103*a*, 105*a*, 107*a*, 109*a*, 103*aa*, 105*aa*, 107*aa*, 109*aa*, 103*b*, 105*b*, 107*b*, 109*b*, 103*bb*, 105*bb*, 107*bb*, 109*bb*, 154*a*, 156*a*, 158*a*, 160*a*, 162*a*, 164*a*, 154*b*, 156*b*, 158*b*, 160*b*, 162*b*, 164*b*, 454*a*, 458*a*, 486*a*, 494*a*, 486*b*, 494*b*, 1146*a*, 1162*a*, 1174*a*, 1162*b*, 1146*b*, and 1174*b*. In FIGS. 8, 9 and 10, a letter "A" represents a voltage to be applied to the voltage supply terminals 154*a*, 158*a* and 164*a*, and a letter "a" represents a voltage applied to the voltage supply terminals 156*a*, 160*a* and 162*a*. A letter "B" represents a voltage applied to the voltage supply terminals 154*b*, 158*b* and 164*b*, and a letter "b" a voltage to the voltage supply terminals 156*b*, 160*b* and 162*b*. A letter "C" represents a voltage to the voltage supply terminal 1146*a*, a letter "D" does a voltage to the voltage supply terminal 1162*a*, a letter "E" does a voltage to the voltage supply terminal 1174*a*, a letter "F" does a voltage to the voltage supply terminal 1146*b*, a letter "G" does a voltage to the voltage supply terminal 1162*b*, a letter "H" does a voltage to the voltage supply terminal 1174*b*, and a letter "I" represents a voltage to be applied to the voltage supply terminal 90*a*. A letter "J" represents a voltage to be applied to the voltage supply terminal 100*a*, a letter "K" does a voltage to be applied to the voltage supply terminal 90*b*, a letter "L" does a voltage to be applied to the voltage supply terminal 100*b*, and a letter "M" represents a voltage to be applied to the voltage supply terminals 454*a*. A letter "N" represents a voltage to be applied to the voltage supply terminal 458*a*, a letter "P" does a voltage to be applied to the voltage supply terminals 486*a* and 486*b*, and a letter "Q" represents a voltage to be applied to the voltage supply terminals 494*a* and 494*b*. In FIGS. 8–10, a numeral "1" represents application of a positive voltage, while a numeral "0" indicates that no voltage is applied. FIGS. 8, 9 and 10 illustrate how the directivity can be changed in the UHF band, the VHFH band, and VHFL band, respectively.

Although not shown in FIGS. 8–10, for receiving the UHF band, a positive voltage is applied, as a voltage T, to the voltage supply terminals 1200*a* and 1200*b* of the variable filters 465*a* and 465*b*, and a positive voltage, as a voltage U, is not applied to the voltage supply terminals 1202*a*, 1202*b*, so that the variable filters 465*a* and 465*b* pass the UHF band therethrough. For receiving the VHFH and VHFL bands, the positive voltage T is not applied to the voltage supply terminals 1200*a*, 1200*b*, but the positive voltage U is applied to the terminals 1202*a* and 1202*b*, so that the variable filters 465*a* and 465*b* pass the VHF band therethrough.

Although not shown in FIGS. 8–10, when signal amplification should be provided by the variable amplifiers 106*a*, 108*a*, 106*b* and 108*b*, a positive voltage is applied from the control unit 180 to the voltage supply terminals 103*a*, 107*a*, 103*aa*, 107*aa*, 103*b*, 107*b*, 103*bb* and 107*bb*, whereas the control unit 180 applies a positive voltage to none of the voltage supply terminals 105*a*, 109*a*, 105*aa*, 109*aa*, 105*b*, 109*b*, 105*bb* and 109*bb*. Similarly, when signal amplification should not be done in the variable amplifiers 106*a*, 108*a*, 106*b* and 108*b*, a positive voltage is not applied from the control unit 180 to any of the voltage supply terminals 103*a*, 107*a*, 103*aa*, 107*aa*, 103*b*, 107*b*, 103*bb* and 107*bb*, whereas the control unit 180 applies a positive voltage to the voltage supply terminals 105*a*, 109*a*, 105*aa*, 109*aa*, 105*b*, 109*b*, 105*bb* and 109*bb*.

In receiving any of the UHF, VHFH and VHFL bands, for the azimuth angle of 0°, 22.5° and 45°, the amount of attenuation given by the variable attenuator 1136*a* is 0 dB, it increases to 7 dB for 67.5° and infinity for 90°, and then decreases to 7 dB and to 0 dB for the angles of 112.5° and 135°. The amount of attenuation given by the attenuator 1136*a* is maintained to be 0 dB for 157.5°, 180°, 202.5° and 225°. It increases to 7 dB and infinity for 247.5° and 270°, respectively, then, decreases to 7 dB and 0 dB for 292.5° and 315°, respectively, and maintains to be 0 dB for the angle of 337.5°.

On the other hand, the amount of attenuation given by the variable attenuator 1136*b* is infinity, 7 dB and 0 dB for the azimuth angles of 0°, 22.5° and 45°, respectively. It is 0 db for the angles of 67.5°, 90°, 112.5° and 135°. For the azimuth angles of 157.5° and 180°, the amount of attenuation given by the variable attenuator 1136*b* is 7 dB and infinity. It is 7 dB and 0 dB for the angles of 202.5° and 225°, and maintains to be 0 dB for the angles of 247.5°, 270°, 292.5°, and 315°. The amount of attenuation for the azimuth angle of 337.5° given by the variable attenuator 1136*b* is 7 dB. Like this, when the amount of attenuation given by one of the variable attenuators 1136*a* and 1136*b* is 0 dB, the amount of attenuation given by the other attenuator increases or decreases.

When receiving VHFH and UHF band signals, the band switching sections 464*a* and 464*b* output VHFH or UHF signals, as shown in FIGS. 8 and 9. When receiving VHFL band signals, the band switching sections 464*a* and 464*b* develop VHFL signals, as shown in FIG. 10. In receiving VHFH signals, due to the action of the coils 30*a*, 30*b*, 38*a*, 38*b*, 66*a*, 66*b*, 74*a* and 74*b*, the extension elements 24*a*, 24*b*, 26*a*, 26*b*, 58*a*, 58*b*, 60*a* and 60*b* are connected to the associated dipole antenna elements 8*a*, 8*b*, 10*a*, 10*b*, 42*a*, 42*b*, 44*a* and 44*b*, respectively.

Because the spacing between the dipole antennas 4*a* and 6*a* of the antenna device 2*a* and the spacing between the dipole antenna 4*b* and 6*b* of the antenna device 2*b* are smaller than a quarter of λ, in the UHF band, the directivities are shaper than when the spacings are equal to a quarter of λ. It has been found that this causes the antenna directivity is distorted at angular positions other than 0°, 90°, 180 and 270°, if the signals are combined in the above-described manner.

In order to solve this problem, when receiving the UHF band, only one of the two extension elements for each of the dipole antennas 4*a* and 6*a* is used to cause the dipole antennas to act as so-called asymmetrically fed dipole antennas exhibiting tilted directivities, which are combined. For that purpose, the voltages I, J, K and L shown in FIG. 8 are used to connect the extension elements 24*a*, 24*b*, 26*a*, 26*b*, 58*a*, 58*b*, 60*a* and 60*b*. More specifically, for orienting the directivity toward 22.5°, 45° and 67.5°, the extension elements 26*a* and 60*a* are connected to the dipole antennas 4*a* and 6*a* so that the combined directivity is tilted clockwise from the forward direction, and the extension elements 24*b* and 58*b* are connected to the dipole antennas 4*b* and 6*b* so that the combined directivity is titled counterclockwise from the rightward direction. Similarly, for orienting the antenna directivity toward 112.5°, 135° and 157.5°, the extension elements 26*a* and 60*a* are connected to the dipole antennas 4*a* and 6*a* so that the combined directivity is tilted counterclockwise from the backward direction, and the extension elements 26*b* and 60*b* are connected to the dipole antennas 4*b* and 6*b* so that the combined directivity is tilted clockwise from the rightward direction. For orienting the antenna directivity toward 202.5°, 225° and 247.5°, the combined directivity of the dipole antennas 4*a* and 6*a* is tilted clockwise from the backward direction and the combined directivity of the dipole antennas 4*b* and 6*b* is tilted counterclockwise from the leftward direction. For orienting the antenna directivity toward 292.5°, 315° and 337.5°, the combined directivity of the dipole antennas 4*a* and 6*a* is tilted counterclockwise from the forward direction, and the combined directivity of the dipole antennas 4*b* and 6*b* is tilted clockwise from the leftward direction.

Figure 11:
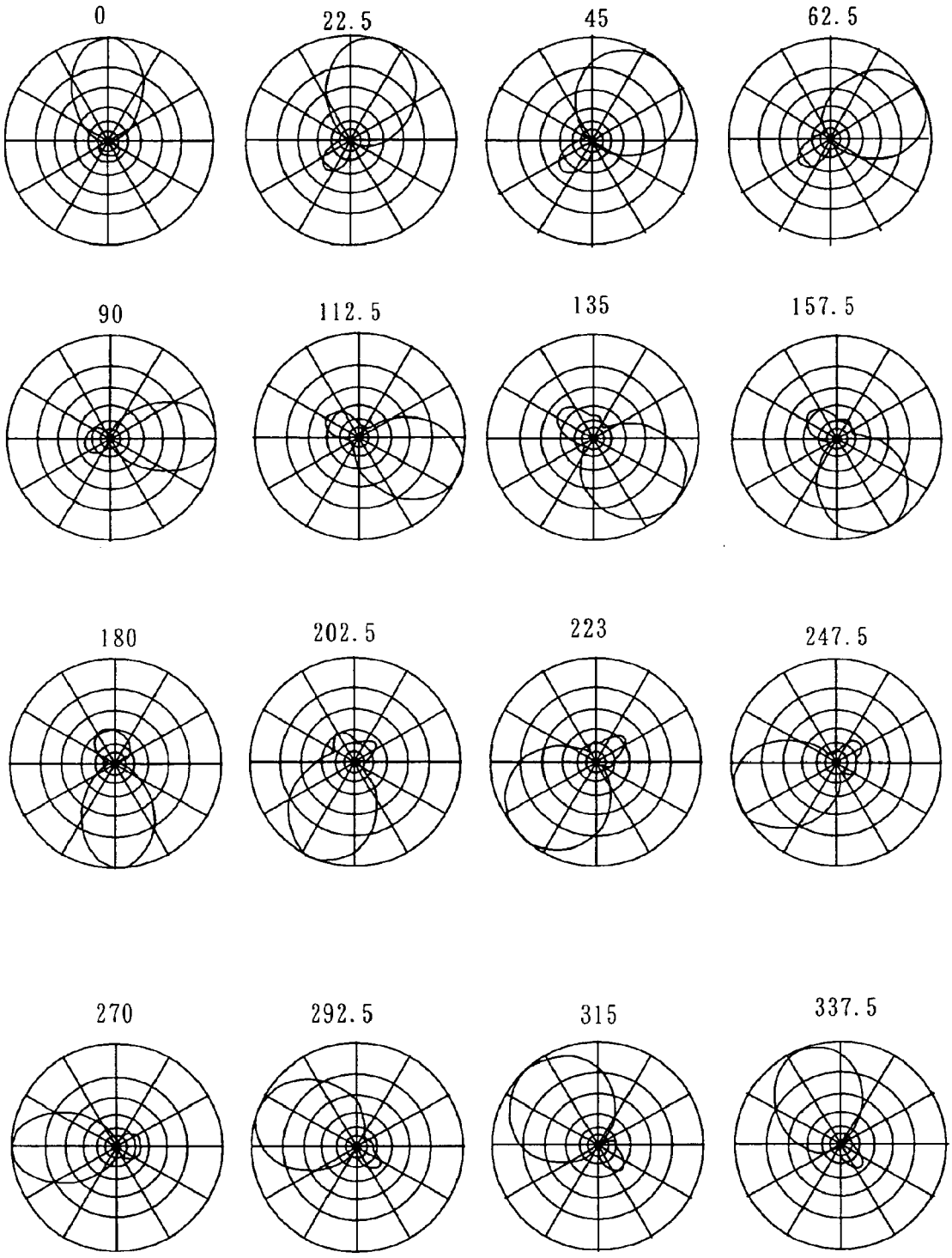
FIG. 11 shows patterns of directivity oriented to various directions of the antenna apparatus of FIG. 1 in the UHF band.

As described previously, the phase adjusting circuit 104*a* uses the fixed phase shifter 152*a* when the combined directivity of the dipole antennas 4*a* and 6*a* is oriented forward or backward, and the phase adjusting circuit 104*b*uses the fixed phase shifter 152*b* when the combined directivity of the dipole antennas 4*b* and 6*b* is oriented leftward or rightward. The amounts of phase shift provided by the fixed phase shifters 152*a* and 152*b* are equal. Accordingly, the phase shift of the signal resulting from combining the signals from the dipole antennas 4*a* and 6*a* in the combiner 1138, and the phase shift of the signal resulting from combining the signals from the dipole antennas 4*b* and 6*b* in the combiner 1138 are equal. Accordingly, this also improves distortion of the directivity at angles other than 0°, 90°, 180° and 270°. FIG. 11 shows the antenna directivity when the UHF band signals are being received, at angles between 0° and 337.5° spaced at regular angular intervals of 22.5°. It is seen that there is no distortion in the directivity patterns at the respective angular positions and that the F/B ratio is high.

The voltages P and Q shown in FIG. 10 are applied when receiving the VHFL band so that the band switching sections 464*a* and 464*b* provide VHFL band signals. Also, the voltages M and N shown in FIG. 10 are applied to the polarity switching section 430*a*, so that, for the angles of 0°, 22.5°, 45°, 67.5°, 180°, 202.5°, 225° and 247.5°, the VHFL band signal from the dipole antenna 400*a* with its polarity not inverted can be developed, while, for the angles of 90°, 112.5°, 135°, 157.5°, 270°, 292.5°, 315° and 337.5°, the VHFL band signal from the dipole antenna 400*a* with its polarity inverted can be developed. The VHFL band signal from the dipole antenna 400*a* is combined with the VHFL band signal from the dipole antenna 400*b*, to thereby rotate the 8-shaped directivity pattern to a desired position.

As described above, the variable directivity antenna apparatus according to the present invention includes VHFL band dipole antennas 400*a*and 400*b*, and, therefore, it can give a sufficiently usable gain in the VHFL region, namely, a region of from 54 MHz to 88 MHz.

Figure 12:
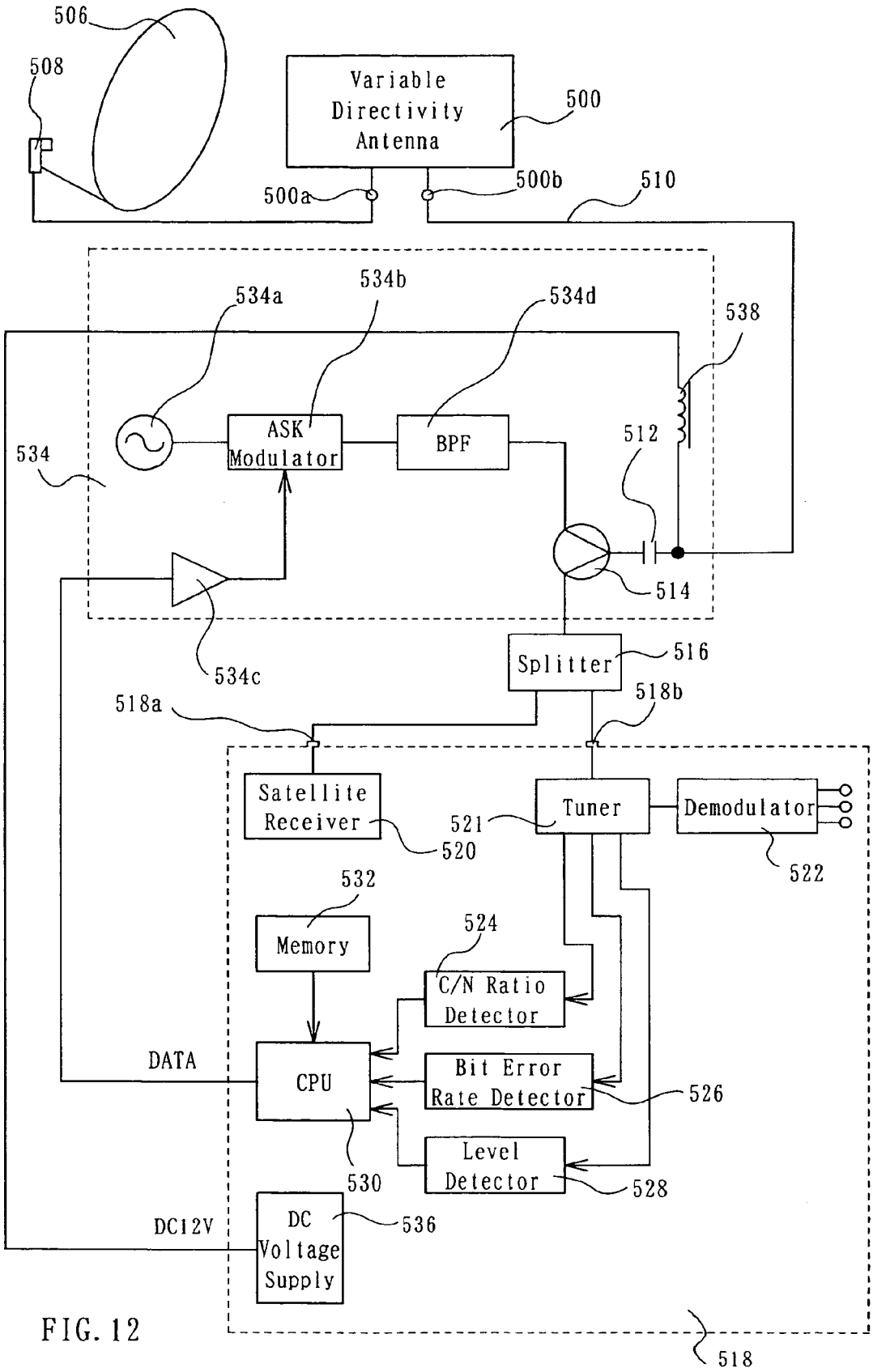
FIG. 12 is a block diagram of a receiver system with which the variable directivity antenna apparatus shown in FIG. 1 is used.

As shown in FIG. 7, the output signal of the combiner 1138 is amplified in an amplifier 501 and applied through a DC blocking capacitor 502 to a mixer 509. As is seen from FIGS. 7 and 12, the mixer 509 receives, via an input terminal 500*a*, a signal from another antenna, e.g. a satellite broadcast intermediate frequency signal developed by frequency converting a satellite broadcast signal received at a satellite broadcast receiving parabolic antenna 506, in a converter 508 associated with the parabolic antenna 506. The mixture signal from the mixer 509 is applied to a splitter 516 through an output terminal 500*b* of the variable directivity antenna 500, a transmission path 510, and a DC blocking capacitor 512 and another mixer 514 within an antenna control commander 534. In the,splitter 516, the mixture signal is separated into the satellite broadcast intermediate frequency signal and the VHF or UHF television broadcast signal. The satellite broadcast intermediate frequency signal is applied to a satellite broadcast intermediate frequency signal input terminal 518*a* of the receiver apparatus 518, and the VHF or UHF television broadcast signal is applied to a UHF/VHF television broadcast signal input terminal 518*b* of the receiver apparatus 518.

The satellite broadcast intermediate frequency signal applied to a satellite broadcast intermediate frequency signal input terminal 518*a* is coupled to a satellite receiver 520, where it is demodulated, and demodulated signal is applied to a television receiver (not shown). The VHF or UHF television broadcast signal applied to a UHF/VHF television broadcast signal input terminal 518*b* is converted, in a tuner 521, to a television broadcast intermediate frequency signal and demodulated in a demodulating unit 522. Regardless whether the VHF or UHF television broadcast signal is analog or digital, demodulation of the signal is done in the demodulating unit 522, and the signal resulting from the demodulation is applied to the television receiver.

The television broadcast intermediate frequency signal is also applied to a reception state detecting section, e.g. a C/N ratio detecting unit 524, a bit error rate detecting unit 526 and a level detecting unit 528. The C/N ratio detecting unit 524 detects a C/N ratio of the VHF or UHF television broadcast signal, and applies its detection result to receiver apparatus control means, e.g. a CPU 530. The bit error rate detecting unit 526 detects a bit error rate of the VHF or UHF television broadcast signal when it is a digital broadcast signal, and applies the detection result to the CPU 530. The level detecting unit 528 detects a level of the VHF or UHF television broadcast signal and applies the detection result to the CPU 530.

The CPU 530 has a memory 532, and, when it receives an external command to receive a VHF or UHF channel, reads out antenna control data for that channel from the memory 532 and applies it to the antenna control commander 534, which causes the antenna apparatus 500 to exhibit directivity oriented to the direction from which the radio wave for that channel comes to the antenna apparatus 500.

The antenna control data is converted to a PSK (Phase Shift Keying) signal, a FSK (Frequency Shift Keying) signal, or an ASK (Amplitude Shift Keying) signal in the antenna control commander 534.

For example, when converting the antenna control data into an ASK signal, a carrier signal generator 534*a* in the antenna control commander 534 generates a carrier signal at a frequency different from the reception signal from the variable directivity antenna apparatus 500. The frequency of the carrier signal may be, for example, 10.7 MHz, and is applied to an ASK modulator 534*b*, to which applied also is the antenna control data from the memory 532 through the CPU 530 and a buffer 534*c*. The carrier signal is ASK modulated with the antenna control data, and the ASK signal is outputted from the modulator 534*b*. The ASK signal is outputted through a bandpass filter 534*d*, which removes undesired signal components, and through the mixer 514 and the DC blocking capacitor 512. It should be noted that for converting the antenna control data to a PSK or FSK signal, the modulator 534*b* is replaced by a modulator for PSK or FSK modulating the carrier signal with the antenna control data.

The PSK, FSK or ASK signal from the modulator is applied through the mixer 514, the DC blocking capacitor 512, the transmission path 510, the output terminal 500*b* of the variable directivity antenna apparatus 500, the mixer 509 and a high-frequency blocking coil 542 to the control unit 180, which provides the various controls described above.

If the currently received channel is a digital broadcast channel, the CPU 530 causes the directivity of the variable directivity antenna apparatus 500 to be varied when a selected one of the C/N ratio, the bit error rate and the level, e.g. the C/N ratio, is below a predetermined reference value associated therewith, i.e. when the reception state is unacceptable, and selects the direction where the C/N ratio above the reference value is achieved. The CPU 530, then, substitutes new antenna control data corresponding to that direction for the current antenna control data for receiving the channel being currently received. The renewed antenna control data is stored in the memory 532. Accordingly, the antenna control data to be subsequently used for receiving that channel is the renewed data. If the bit error rate is selected, the renewal of the antenna control data is done when the bit error rate decreases below the associated reference value, and if the signal level is selected the antenna control data renewal is done when the level is below the associated reference value.

If the currently received channel is an analog broadcast channel, the CPU 530 causes the directivity of the antenna apparatus 500 to be adjusted in a manner similar to the above-stated one when a selected one of the C/N ratio and the signal level is below a reference value predetermined therefor, and the antenna control data renewal is done.

A DC voltage, e.g. DC 12 V, is applied from a DC voltage supply 536 in the receiver apparatus 518 to the transmission path 510 via a high-frequency blocking coil 538 in the antenna control commander 534, and from which it is applied to the UHF/VHF band television broadcast signal output terminal 500*b* of the antenna apparatus 500. This voltage is then applied through the mixer 509 and the high-frequency blocking coil 542 to a voltage supply 540, from which power is supplied to the control unit 180 etc., as shown in FIG. 7.

Figure 13:
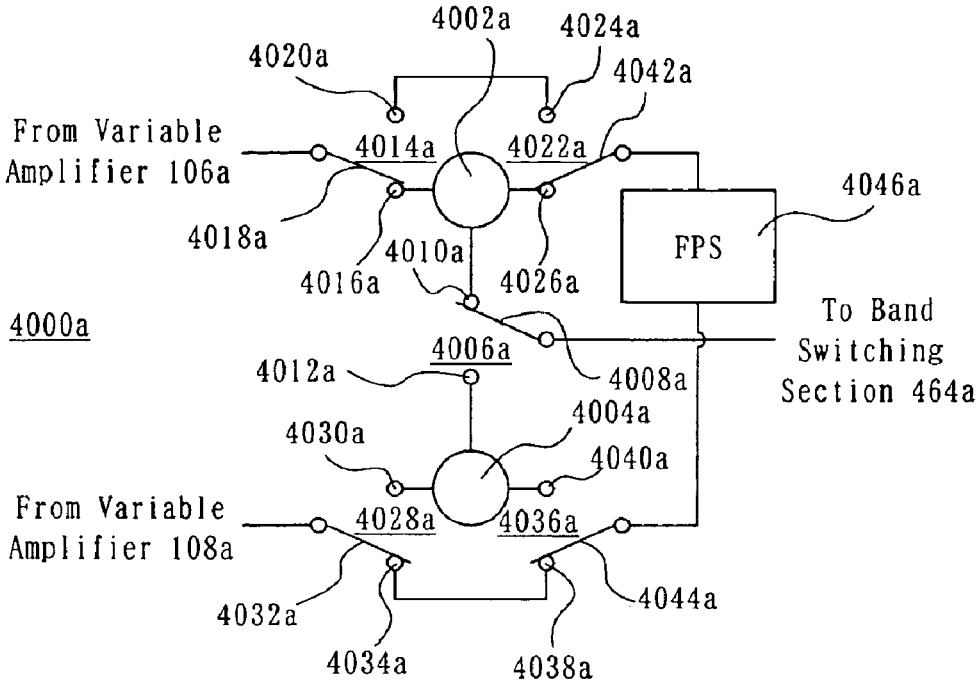
FIG. 13 is part of a circuit diagram of a variable directivity antenna apparatus according to a second embodiment of the present invention.
Figure 13:
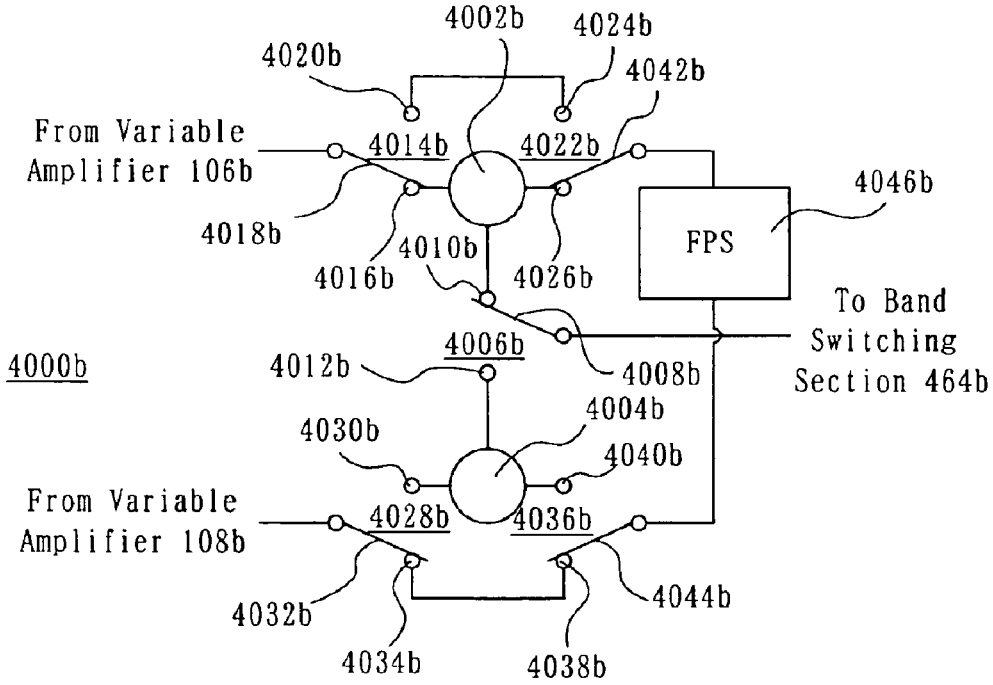

A variable directivity antenna according to a second embodiment of the present invention has a configuration similar to the antenna apparatus 500 according to the first embodiment, except that phase adjusting circuits 4000*a* and 4000*b* shown in FIG. 13 are used in place of the phase adjusting circuits 104*a* and 104*b* of the antenna apparatus 500.

The phase adjusting circuit 4000*a* includes two mixers 4002*a* and 4004*a*, and their outputs are selectively coupled to the band switching section 464*a* through a changeover switch 4006*a*.

The changeover switch 4006*a* has its movable arm 4008*a* connected to the band switching section 464*a*, has its contact 4010*a* connected to the output of the mixer 4002*a*, and has its another contact 4012*a* connected to the output of the mixer 4004*a*.

One input of the mixer 4002*a* is connected to a contact 4016*a* of a changeover switch 4014*a*, which has its movable arm 4018*a* connected to the variable amplifier 106*a*. Another contact 4020*a* of the switch 4014*a* is connected to a contact 4024*a* of a changeover switch 4022*a*. Another contact 4026*a* of the switch 4022*a* is connected to another input of the mixer 4002*a*.

Similarly, a contact 4030*a* of a changeover switch 4028*a* is connected to one input of the mixer 4004*a*. The changeover switch 4028*a* has its movable arm 4032*a* connected to the variable amplifier 108*a*. Another contact 4034*a* of the switch 4028*a* is connected to a contact 4038*a* of a changeover switch 4036*a*, which has its contact 4040*a* connected to the other input of the mixer 4004*a*.

A fixed phase shifter 4046*a* is connected between a movable arm 4042*a* of the switch 4022*a* and a movable arm 4044*a* of the switch 4036*a*. The amount of phase shift provided by the fixed phase shifter 4046*a* is determined in the same manner as the one for the fixed phase shifter 152*a* of the antenna apparatus according to the first embodiment.

The control unit 180 performs such control that, when the movable arm 4008*a* of the changeover switch 4006*a* is in contact with the contact 4010*a*, the movable arm 4018*a* of the changeover switch 4014*a* is in contact with the contact 4016*a*, the movable arm 4042*a* of the changeover switch 4022*a* is in contact with the contact 4026*a*, the movable arm 4032*a* of the changeover switch 4028 is in contact with the contact 4034*a*, and the movable arm 4044*a* of the changeover switch 4036*a* is in contact with the contact 4038*a*. In this state, the output signal of the variable amplifier 106*a*, i.e. the reception signal form the antenna 4*a*, is applied, as it is, to the mixer 4002*a*, whereas the output signal of the variable amplifier 108*a*, i.e. the reception signal from the antenna 6*a*, is phase shifted in the fixed phase shifter 4046*a* before being applied to the mixer 4002*a*. This causes the combined directivity of the antennas 4*a* and 6*a* to be oriented toward the forward direction, as in the first embodiment.

When the movable arm 4008*a* of the switch 4006*a* is in contact with the contact 4012*a*, such control is provided that the movable arm 4018*a* of the switch 4014*a* contacts the contact 4020*a*, the movable arm 4042*a* of the switch 4022*a* is in contact with the contact 4024*a*, the movable contact 4032*a* of the switch 4028*a* is in contact with the contact 4030*a*, and the movable arm 4044*a* of the switch 4036*a* is in contact with the contact 4040*a*. In this state, the output signal of the variable amplifier 106*a*, i.e. the reception signal from the antenna 4*a*, is phase shifted in the fixed phase shifter 4046*a* before it is applied to the mixer 4004*a*, whereas the output signal of the variable amplifier 108*a*, i.e. the reception signal from the antenna 6*a* is applied, as it is, to the mixer 4004*a*. This causes the combined directivity of the antennas 4*a* and 6*a* to be oriented toward the backward direction, as in the first embodiment.

The phase adjusting circuit 4000*b* has the same configuration as the phase adjusting circuit 4000*a*, and the combined directivity of the antennas 4*b* and 6*b* is oriented toward the leftward or rightward direction. The components of the phase adjusting circuit 4000*b* same as or similar to those of the phase adjusting circuit 4000*a* are given the same reference numerals with a suffix "b" substituted for the suffix "a", and their detailed description is no given.

What is claimed is:

1. A variable directivity antenna apparatus comprising:

a first antenna device for receiving radio waves in a first frequency band, comprising first and second antennas each exhibiting an 8-shaped directivity extending along the direction perpendicular to the length direction of said first and second antennas, said first and second antennas being spaced in parallel with each other, with a spacing less than about a quarter of a wavelength of said first frequency band disposed therebetween;

a second antenna device for receiving radio waves in said first frequency band, comprising third and fourth antennas each exhibiting an 8-shaped directivity extending along the direction perpendicular to the length direction of said third and fourth antennas, said third and fourth antennas being spaced in parallel with each other, with said spacing disposed therebetween, and extending in the direction perpendicular to said first and second antennas;

first phase adjusting means for adjusting phases of reception signals resulting from reception by said first and second antennas of a radio wave and combining the phase adjusted reception signals in such a manner that the resulting combined signal selectively assumes a first directivity state in which the combined signal exhibits directivity toward a first direction perpendicular to said first and second antennas and assumes a second directivity state in which the combined signal exhibits directivity toward a second direction opposite to said first direction, said first direction being such a direction that a radio wave coming in said first direction arriving at said second antenna earlier than said first antenna;

second phase adjusting means for adjusting phases of reception signals resulting from reception by said third and fourth antennas of a radio wave and combining the phase adjusted reception signals in such a manner that the resulting combined signal selectively assumes a third directivity state in which the combined signal exhibits directivity toward a third direction perpendicular to said third and fourth antennas and assumes a fourth directivity state in which the combined signal exhibits directivity toward a fourth direction opposite to said third direction, said third direction being such a direction that a radio wave coming in said third direction arriving at said fourth antenna earlier than said third antenna; and signal combining means for adjusting the level of the output signal of said first phase adjusting means in said first or second directivity state and the level of the output signal of said second phase adjusting means in said third or fourth directivity state, and combining the level adjusted output signals of said first and second phase adjusting means for developing an output signal selectively exhibiting directivity oriented toward said first, second, third and fourth directions and the directions between adjacent ones of said first, second, third and fourth directions;

wherein:

said first phase adjusting means phase shifts one of the reception signals from said first and second antennas by a predetermined amount to thereby produce said first directivity state, and phase shifts the other of the reception signals from said first and second antennas by said predetermined amount to thereby produce said second directivity state; and said second phase adjusting means phase shifts one of the reception signals from said third and fourth antennas by said predetermined amount to thereby produce said third directivity state, and phase shifts the other of the reception signals from said third and fourth antennas by said predetermined amount to thereby produce said fourth directivity state.

2. The variable directivity antenna apparatus according to claim 1 wherein:

said first phase adjusting means comprises:

first combining means for combining reception signals from said first and second antennas;

a first phase shifter; and first switching means for coupling the reception signal from said second antenna to said first combining means through said first phase shifter when the reception signal from said first antenna is being coupled to said first combining means, and coupling the reception signal from said first antenna to said first combining means through said first phase shifter when the reception signal from said second antenna is being coupled to said first combining means; and said second phase adjusting means comprises:

second combining means for combining reception signals from said third and fourth antennas;

a second phase shifter providing an amount of phase shift equal to an amount of phase shift provided by said first phase shifter; and second switching means for coupling the reception signal from said fourth antenna to said second combining means through said second phase shifter when the reception signal from said third antenna is being coupled to said second combining means, and coupling the reception signal from said third antenna to said second combining means through said second phase shifter when the reception signal from said fourth antenna is being coupled to said second combining means.

3. The variable directivity antenna apparatus according to claim 1 wherein:

said first phase adjusting means comprises:

third and fourth combining means, a selected one of said third and fourth combining means being adapted to develop an output signal;

a first phase shifter; and third switching means operating in such a manner that, when the output signal of said third combining means is selected, a reception signal from said first antenna is coupled to said third combining means, with a reception signal from said second antenna coupled to said third combining means through said first phase shifter, and that, when the output signal of said fourth combining means is selected, the reception signal from said second antenna is coupled to said fourth combining means with the reception signal from said first antenna coupled to said fourth combining means through said first phase shifter; and said second phase adjusting means comprises:

fifth and sixth combining means, a selected one of said fifth and sixth combining means being adapted to develop an output signal;

a second phase shifter providing an amount of phase shift equal to an amount of phase shift provided by said first phase shifter; and fourth switching means operating in such a manner that, when the output signal of said fifth combining means is selected, a reception signal from said third antenna is coupled to said fifth combining means, with a reception signal from said fourth antenna coupled to said fifth combining means through said second phase shifter, and that, when the output signal of said sixth combining means is selected, the reception signal from said fourth antenna is coupled to said sixth combining means with the reception signal from said third antenna coupled to said sixth combining means through said second phase shifter.

4. The variable directivity antenna apparatus according to claim 1 wherein reception signals from said first and second antennas are amplified in first and second amplifiers, respectively, before being coupled to said first phase adjusting means, and reception signals from said third and fourth antennas are amplified in third and fourth amplifiers, respectively, before being coupled to said second phase adjusting means.

5. The variable directivity antenna apparatus according to claim 1 wherein:

said first, second, third and fourth antennas are dipole antenna;

first and second extension elements are connected to opposite ends of said first antenna through first and second switching devices, respectively;

third and fourth extension elements are connected to opposite ends of said second antenna through third and fourth switching devices, respectively;

fifth and sixth extension elements are connected to opposite ends of said third antenna through fifth and sixth switching devices, respectively;

seventh and eighth extension elements are connected to opposite ends of said fourth antenna through seventh and eighth switching devices, respectively;

said first and third switching devices are disposed on corresponding sides of said first antenna device;

said second and fourth switching devices are disposed on corresponding sides of said first antenna device;

said fifth and seventh switching devices are disposed on corresponding sides of said second antenna device;

said sixth and eighth switching devices are disposed on corresponding sides of said second antenna device; and when the output signal of said signal combining means exhibits directivity oriented in a direction other than said first, second, third and fourth directions, a pair of said first and third switching devices and a pair of said second and fourth switching devices of said first antenna device are selectively closed, and a pair of said fifth and seventh switching devices and a pair of said sixth and eighth switching devices of said second antenna device are selectively closed.

6. The variable directivity antenna apparatus according to claim 5 wherein said first antenna with said first and second extension elements connected thereto is capable of receiving radio waves in a second frequency band lower than said first frequency band, said second antenna with said third and fourth extension elements connected thereto is capable of receiving radio waves in said second frequency band, said third antenna with said fifth and sixth extension elements connected thereto is capable of receiving radio waves in said second frequency band, and said fourth antenna with said seventh and eighth extension elements connected thereto is capable of receiving radio waves in said second frequency band.

7. The variable directivity antenna apparatus according to claim 6 further comprising:

a fifth antenna for receiving radio waves in a third frequency band lower than said second frequency band, said fifth antenna exhibiting an 8-shaped directivity pattern and being disposed between and in parallel with said first and second antennas;

a sixth antenna for receiving radio waves in said third frequency band, said sixth antenna exhibiting an 8-shaped directivity pattern and being disposed between and in parallel with said third and fourth antennas;

when receiving radio waves in said third frequency band, reception signals from said fifth and sixth antennas are coupled to said signal combining means.

8. The variable directivity antenna apparatus according to claim 1 wherein said signal combining means comprises:

first level adjusting means to which an output signal of said first phase adjusting means is coupled;

second level adjusting means to which an output signal of said second phase adjusting means is coupled; and combining means for combining output signals of said first and second level adjusting means;

each of said first and second level adjusting means can selectively assume a first factor state in which an input signal applied thereto is outputted with a level proportional to a first factor, a second factor state in which an input signal applied thereto is outputted with a level proportional to a second factor smaller than said first factor, and a blocking state in which an input signal applied thereto is blocked;

said first and second level adjusting means are adapted to be switched selectively into a first state in which said first level adjusting means is in said first factor state, with said second level adjusting means placed in said blocking state, a second state in which said first level adjusting means is in said first factor state, with said second level adjusting means placed in said second factor state, a third state in which said first and second level adjusting means are in said second factor state, a fourth state in which said first level adjusting means is in said second factor state, with said second level adjusting means placed in said first factor state, and a fifth state in which said first level adjusting means is in said blocking state, with said second level adjusting means placed in said first factor state.

9. The variable directivity antenna apparatus according to claim 6 wherein said signal combining means comprises:

first level adjusting means to which an output signal of said first phase adjusting means is coupled;

second level adjusting means to which an output signal of said second phase adjusting means is coupled; and combining means for combining output signals of said first and second level adjusting means;

each of said first and second level adjusting means can selectively assume a first factor state in which an input signal applied thereto is outputted with a level proportional to a first factor, a second factor state in which an input signal applied thereto is outputted with a level proportional to a second factor smaller than said first factor, and a blocking state in which an input signal applied thereto is blocked;, said first and second level adjusting means are adapted to be switched selectively into a first state in which said first level adjusting means is in said first factor state, with said second level adjusting means placed in said blocking state, a second state in which said first level adjusting means is in said first factor state, with said second level adjusting means placed in said second factor state, a third state in which said first and second level adjusting means are in said second factor state, a fourth state in which said first level adjusting means is in said second factor state, with said second level adjusting means placed in said first factor state, and a fifth state in which said first level adjusting means is in said blocking state, with said second level adjusting means placed in said first factor state.

10. A receiver system comprising:

a first antenna device for receiving radio waves in a first frequency band, comprising first and second antennas each exhibiting an 8-shaped directivity extending along the direction perpendicular to the length direction of said first and second antennas, said first and second antennas being spaced in parallel with each other, with a spacing less than about a quarter of a wavelength of said first frequency band disposed therebetween;

a second antenna device for receiving radio waves in said first frequency band, comprising third and fourth antennas each exhibiting an 8-shaped directivity extending along the direction perpendicular to the length direction of said third and fourth antennas, said third and fourth antennas being spaced in parallel with each other, with said spacing disposed therebetween, and extending in the direction perpendicular to said first and second antennas;

first phase adjusting means for adjusting phases of reception signals resulting from reception by said first and second antennas of a radio wave and combining the phase adjusted reception signals in such a manner that the resulting combined signal is caused, in response to a control signal, to selectively assume a first directivity state in which the combined signal exhibits directivity toward a first direction perpendicular to said first and second antennas and a second directivity state in which the combined signal exhibits directivity toward a second direction opposite to said first direction, said first direction being such a direction that a radio wave coming in said first direction arriving at said second antenna earlier than said first antenna;

second phase adjusting means for adjusting phases of reception signals resulting from reception by said third and fourth antennas of a radio wave and combining the phase adjusted reception signals in such a manner that the resulting combined signal is caused, in response to said control signal, to selectively assume a third directivity state in which the combined signal exhibits directivity toward a third direction perpendicular to said third and fourth antennas and a fourth directivity state in which the combined signal exhibits directivity toward a fourth direction opposite to said third direction, said third direction being such a direction that a radio wave coming in said third direction arriving at said fourth antenna earlier than said third antenna;

signal combining means for adjusting the level of the output signal of said first phase adjusting means in said first or second directivity state and the level of the output signal of said second phase adjusting means in said third or fourth directivity state, and combining the level adjusted output signals of said first and second phase adjusting means for developing an output signal selectively exhibiting, in response to said control signal, directivity oriented toward said first through fourth directions and directions between adjacent ones of said first through fourth directions;

control means for demodulating a modulated signal to thereby generate said control signal;

a receiver apparatus to which the output signal of said signal combining means is coupled via a transmission path; and a modulator for applying said modulated signal to said control means via said transmission path, said modulated signal comprising a carrier modulated with said control signal;

wherein:

said first phase adjusting means phase shifts one of the reception signals from said first and second antennas by a predetermined amount to thereby produce said first directivity state, and phase shifts the other of the reception signals from said first and second antennas by said predetermined amount to thereby produce said second directivity state; and said second phase adjusting means phase shifts one of the reception signals from said third and fourth antennas by said predetermined amount to thereby produce said third directivity state, and phase shifts the other of the reception signals from said third and fourth antennas by said predetermined amount to thereby produce said third directivity state.

11. The receiver system according to claim 10 wherein said modulated signal is an amplitude shift keying (ASK) modulated signal.

12. The receiver system according to claim 10 wherein a reception signal from another antenna is combined with the output signal of said signal combining means, and the resulting combined signal is coupled through said transmission path to said receiver apparatus.

13. The receiver system according to claim 10 wherein said receiver apparatus comprises a generator generating said control signal, reception state detecting means for detecting a reception state in which a desired radio wave is being received, and receiver apparatus control means operating, when said reception state becomes unacceptable, varying said control signal applied from said control signal generator to said modulator to thereby make said reception state acceptable, and applying, to said modulator, said control signal that makes said reception state, as detected by said reception state detecting means acceptable.

* * * * *